US010729954B2

(12) United States Patent
Hennenberg

(10) Patent No.: US 10,729,954 B2
(45) **Date of Patent: *Aug. 4, 2020**

(54) SYSTEMS AND METHODS FOR PROTECTING GOLF BAG CONTENTS

(71) Applicant: Michael C. Hennenberg, Cleveland, OH (US)

(72) Inventor: Michael C. Hennenberg, Cleveland, OH (US)

( * ) Notice: Subject to any disclaimer, the term of this patent is extended or adjusted under 35 U.S.C. 154(b) by 13 days.

This patent is subject to a terminal disclaimer.

(21) Appl. No.: 15/894,614

(22) Filed: Feb. 12, 2018

(65) Prior Publication Data

US 2018/0161648 A1 Jun. 14, 2018

Related U.S. Application Data

(63) Continuation of application No. 14/508,153, filed on Oct. 7, 2014, now Pat. No. 9,889,354.

(51) Int. Cl.
*A63B 55/00* (2015.01)

(52) U.S. Cl.
CPC ..... *A63B 55/404* (2015.10); *A63B 2210/50* (2013.01)

(58) Field of Classification Search
CPC ..... A63B 55/404; A63B 2210/50
See application file for complete search history.

(56) References Cited

U.S. PATENT DOCUMENTS

| | | | | |
|---|---|---|---|---|
| 2,910,078 | A * | 10/1959 | Schunck | A45B 17/00 135/27 |
| 4,522,300 | A * | 6/1985 | Hamblet | A45B 11/00 135/16 |
| 5,297,570 | A * | 3/1994 | Conner | A45B 11/00 135/16 |
| 5,447,228 | A * | 9/1995 | Hodgson, III | A63B 55/00 206/315.3 |
| 5,620,034 | A * | 4/1997 | Flis | A63B 55/406 150/159 |
| 7,124,888 | B1 * | 10/2006 | Valdez | A63B 55/406 206/315.4 |
| 9,016,298 | B2 * | 4/2015 | Mausen | A01M 31/025 135/901 |
| 9,889,354 | B2 * | 2/2018 | Hennenberg | A63B 55/404 |
| 2005/0279396 | A1 * | 12/2005 | Choi | A45B 11/04 135/133 |
| 2007/0284022 | A1 * | 12/2007 | Hall | A63B 60/62 150/159 |
| 2013/0098410 | A1 * | 4/2013 | Prasannakumar | A45B 11/00 135/16 |

* cited by examiner

*Primary Examiner* — Tri M Mai
(74) *Attorney, Agent, or Firm* — Dickinson Wright PLLC

(57) ABSTRACT

A system is delineated for protecting golf bag contents. The system may comprise a golf bag; a telescopic member coupled to the golf bag, wherein the telescopic member resides in a stowed state substantially within the golf bag and is selectively moved to a deployed state to facilitate protecting the contents of the golf bag; and a cover coupled to the telescopic member, wherein the cover resides in a stowed state when the telescopic member is in its stowed state and is selectively moved by movement of the telescopic member to a deployed state for the cover to protect the contents of the golf bag. The system may be manufactured integrally with a golf bag or as a separate piece for installation on a golf bag.

18 Claims, 25 Drawing Sheets

SYSTEMS AND METHODS FOR PROTECTING GOLF BAG CONTENTS

CROSS-REFERENCE TO RELATED APPLICATION

This application is related to and claims the benefit and priority of U.S. Non-Provisional patent application Ser. No. 14/508,153, filed Oct. 7, 2014, titled "SYSTEMS AND METHODS FOR PROTECTING GOLF BAG CONTENTS" the entirety of which is hereby incorporated herein by reference.

BACKGROUND OF THE INVENTION

Field of the Invention

The present invention relates to golf equipment, and more particularly, to systems and methods for protecting golf bag contents.

Description of the Related Art

A golfer usually carries golf clubs in a golf bag. Current golf bags may be made of nylon, canvas and/or leather, with plastic or metal reinforcement and framing. Golf bags may have several pockets designed for carrying various equipment and supplies required over the course of a round of golf. Many golf bags are sectioned off with rigid supports at the top opening, both for rigidity and to separate clubs of various types for easier selection. Some more expensive golf bags may have sleeves or pockets within the main compartment for each individual club, allowing for the desired club to be more easily removed from the bag and then returned without interference from the grips of the other clubs or internal hardware of the bag.

Carry-type golf bags may generally be designed to be carried by the player while on the course. Such golf bags may have a single strap or dual shoulder straps and are generally of lightweight construction to reduce the burden on the player or caddy.

Stand-type golf bags may be considered to be in the family of carry bags but additionally may feature rigid internal reinforcement and retractable fold-out legs, which make the bag a tripod, allowing it to be securely placed on the turf. Modern carry bags are very commonly stand bags.

Cart-type golf bags may be generally designed to be harnessed to a two-wheeled pull cart or a motorized golf cart during play of a round. They often have only a rudimentary carry strap or handle for loading and transporting the bag, and no stand legs, but may feature extra storage or more durable construction, as weight of the loaded bag is a lesser concern.

Regardless of the type of golf bag, and the above list of golf bags is not exhaustive of all golf bag types, a common problem affecting users of any type of golf bag is protection of the golf bag equipment (e.g., golf clubs and other golf accessories) from the elements, as well as protecting the golf bag equipment from unauthorized access to same. Many golf bags come with a cover that a user may attach to the golf bag to cover the golf bag contents from whether exposure. Attaching such a cover is generally difficult and inconvenient. For at least these reasons, most golfers simply store their golf bag cover in a golf bag pocket, and the cover is generally not used at all, leaving the golf bag equipment subject to exposure to the weather elements, as well as to a heightened risk of unauthorized access to the golf bag equipment and theft thereof.

Thus, a need exists for improved systems and methods for protecting golf bag equipment, which overcome these and other problems.

SUMMARY OF THE INVENTION

In accordance with an embodiment of the present invention, a system is disclosed for protecting contents of a provided golf bag, the system comprising a telescopic member coupled to the provided golf bag, wherein the telescopic member resides in a stowed state substantially within the provided golf bag and is selectively moved to a deployed state to facilitate protecting the contents of the provided golf bag; and a cover coupled to the telescopic member, wherein the cover resides in a stowed state when the telescopic member is in its stowed state and is selectively moved by movement of the telescopic member to a deployed state for the cover to protect the contents of the provided golf bag.

In accordance with another embodiment of the present invention, a system is disclosed for protecting golf bag contents, the system comprising a golf bag; a telescopic member coupled to the golf bag, wherein the telescopic member resides in a stowed state substantially within the golf bag and is selectively moved to a deployed state to facilitate protecting the contents of the golf bag; and a cover coupled to the telescopic member, wherein the cover resides in a stowed state when the telescopic member is in its stowed state and is selectively moved by movement of the telescopic member to a deployed state for the cover to protect the contents of the golf bag.

In accordance with yet another embodiment of the present invention a method is disclosed for protecting contents of a provided golf bag, the method comprising raising a telescopic member coupled to the provided golf bag, wherein the telescopic member resides in a stowed state substantially within the provided golf bag and is selectively moved to a deployed state to facilitate protecting the contents of the provided golf bag; and raising a cover coupled to the telescopic member, wherein the cover resides in a stowed state when the telescopic member is in its stowed state and is selectively moved by movement of the telescopic member to a deployed state for the cover to protect the contents of the provided golf bag.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present exemplary embodiments of the invention, examples of which are illustrated in the accompanying drawings.

Figure 1A:
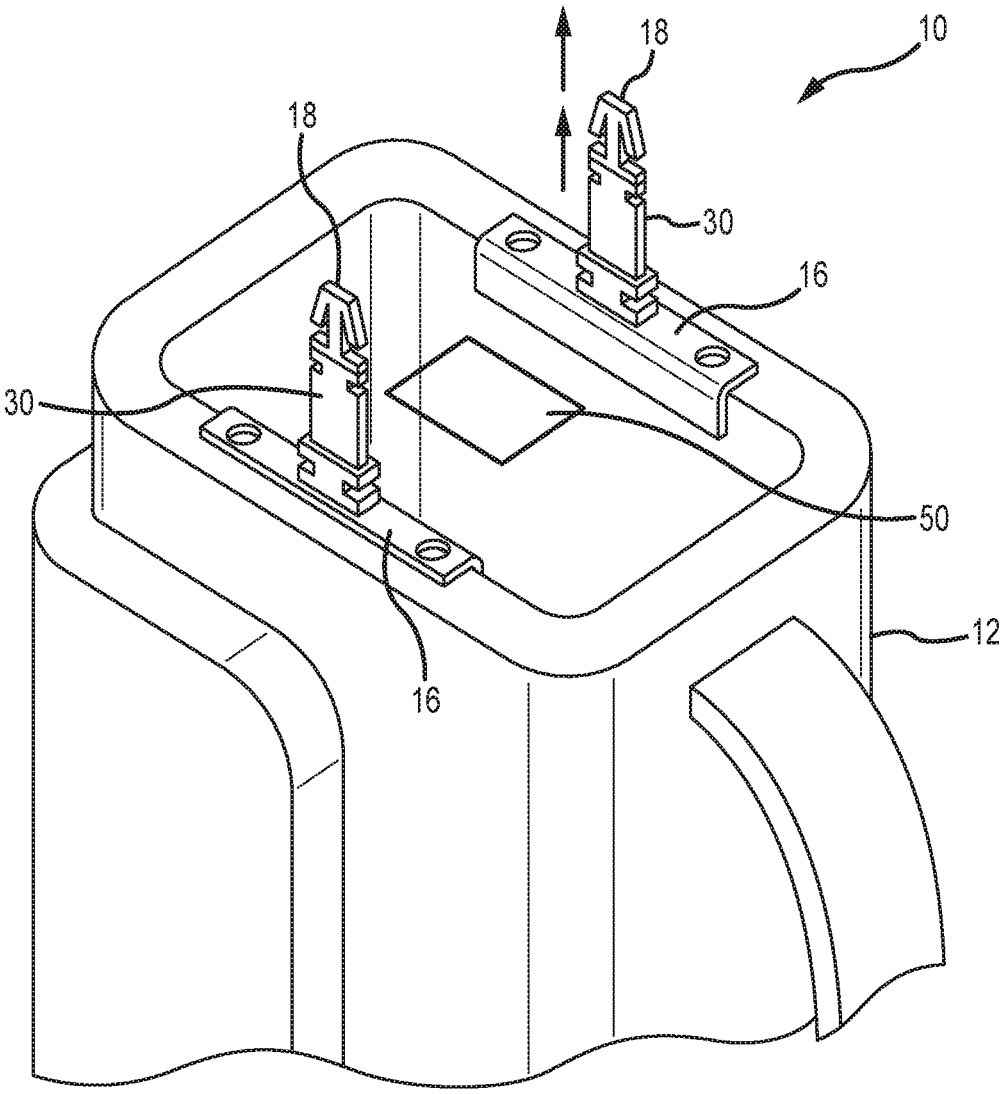
FIGS. 1A-D present a series of perspective views of an embodiment of a containment system, in accordance with systems and methods consistent with the present invention.
Figure 1B:
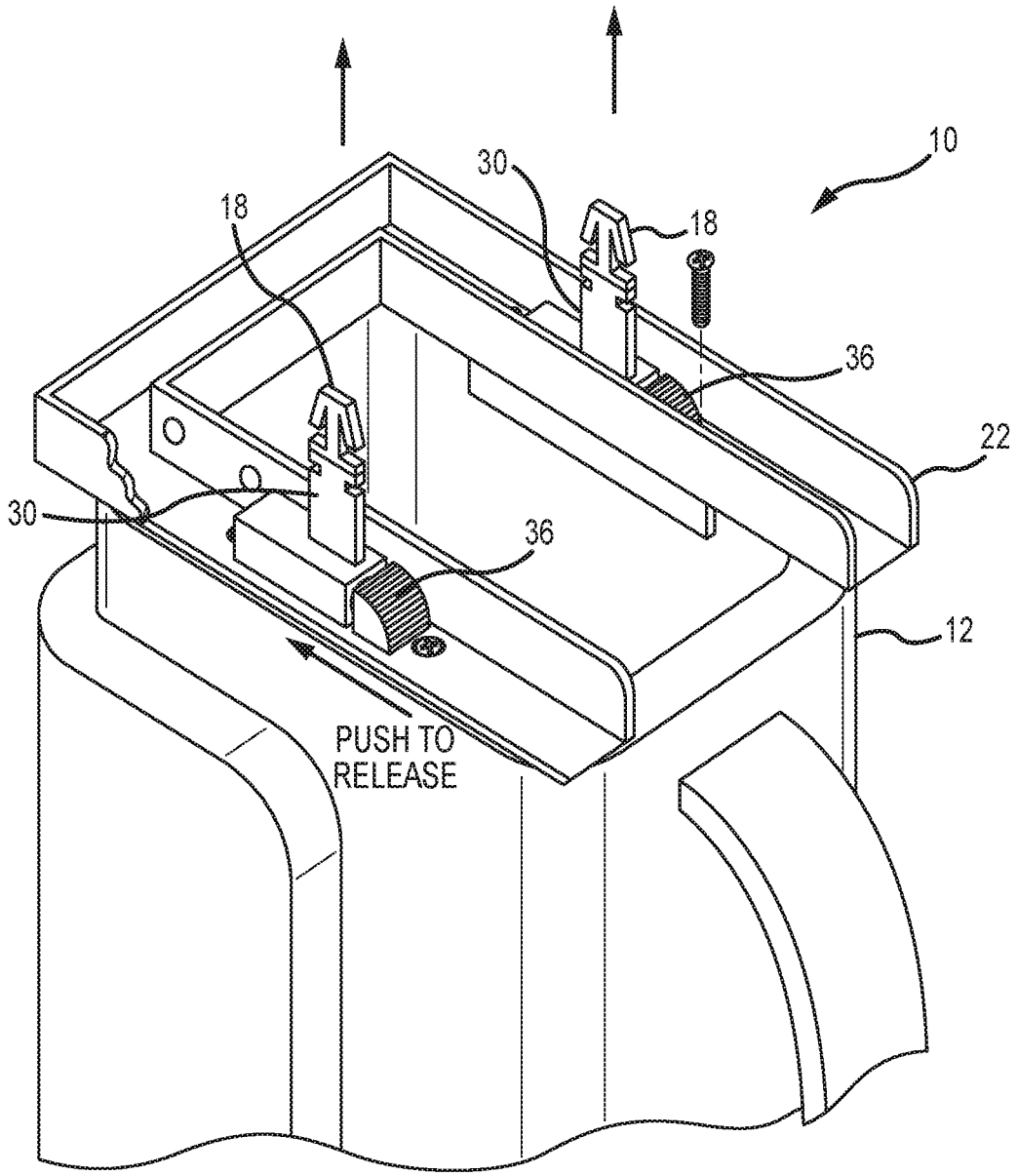
Figure 1C:
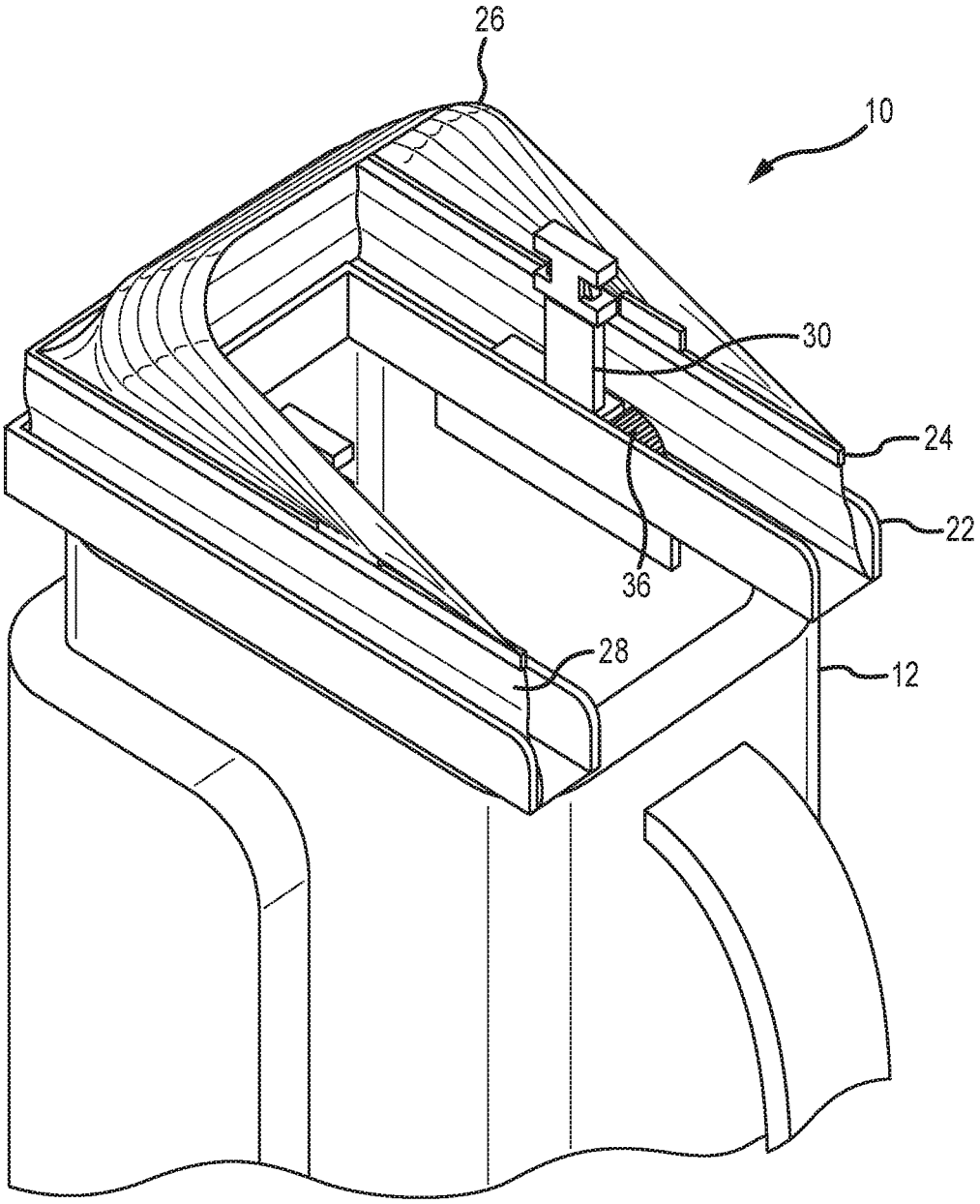
Figure 1D:
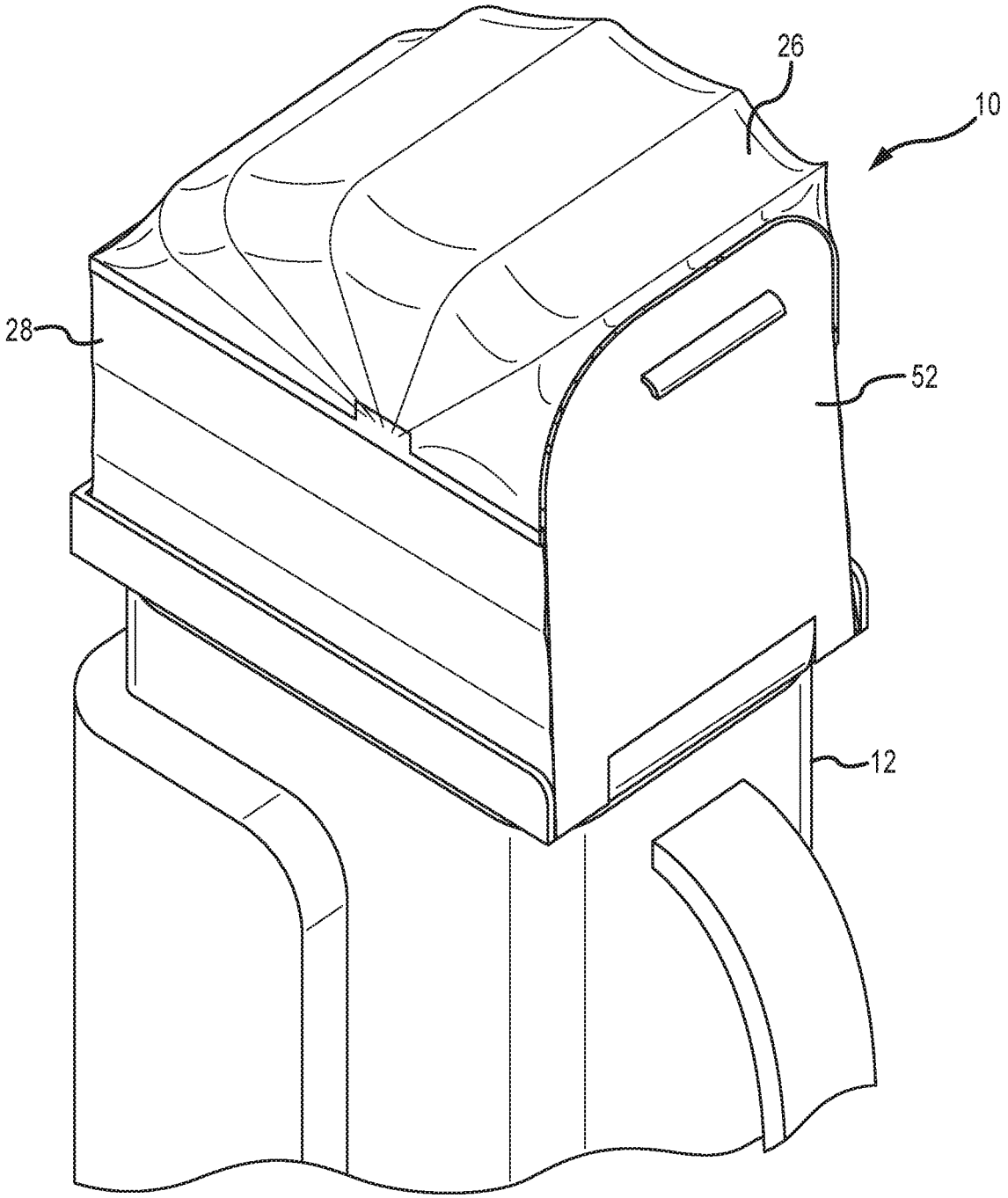

FIGS. 1A-D present a series of perspective views of an embodiment of a containment system 10, in accordance with systems and methods consistent with the present invention. FIGS. 1A and 1B show partial views of system 10, and FIGS. 1C and 1D depict a progression of system 10 from an initial partially deployed state (FIG. 1C) to a fully deployed state (FIG. 1D).

Regarding FIG. 1A, certain elements of system 10 are shown with a golf bag 12. System 10 may be employed with any golf bag 12 now or hereafter available. Golf bag 12 may include golf equipment 50, representing golf clubs and any other equipment that may be contained within the storage volume of golf bag 12. It should be noted that system 10 may be a separate system that may be coupled to golf bag 12, or alternatively, golf bag 12 may be assembled to include system 10 as an integral part of golf bag 12.

Still with reference to FIG. 1A, system 10 may include a pair of retaining clamps 16 that may be coupled to golf bag 12 using screws (not shown) penetrating a pair of attachment apertures located in each retaining clamp 16. Any other means for attaching retaining clamps 16 to golf bag 12 may be employed. Each retaining clamp 16 may be coupled to an upper member 30. The upper end of each upper member 30 may include a coupler 18 for attaching other elements of system 10 to be shown and described hereafter. Upper member 30 may be slidably engaged by retaining clamp 16 so that each upper member 30 may be moved along its vertical axis, as represented by the upwardly-pointing arrows in FIG. 1A. Upper members 30 may be moved in either the upward or downward direction along the vertical axis of upper members 30.

Referring to FIG. 1B, further elements of system 10 are depicted. A base member 22 may be attached, using connectors or any other suitable means, to golf bag 12 and over retaining clamps 16. A release actuator 36 may be coupled to base member 22. Depressing release actuator 36 may permit the release of upper members 30 to be deployed from a stowed state to a deployed state. As shown here, upper members 30 have been released by depression of release actuator 36, permitting upper members 30 to move vertically upward from their stowed state.

Referring to FIG. 1C, further elements of system 10 are depicted. A lower cover 28 may be attached along its lower edge to an upper surface of base member 22. Any suitable attachment technique may be employed, such as the use of Velcro fasteners or any other desired fastening system. The upper edge of lower cover 28 may be coupled to an upper member 24. Upper member 24 may have a general shape that corresponds to the general shape of base member 22, in this case a generally C-shaped configuration. Attached to an upper surface of upper member 24 may be an upper cover 26.

Referring to FIG. 1D, system 10 is shown in a fully deployed state, permitting coverage of and protection for golf equipment 50. In this state, upper members 30 are fully raised, thereby raising lower cover 28 from its initial stowed state to the fully deployed state shown. A user may then pull upper cover 26 forward toward the back side of golf bag 12 (i.e., the backside of golf bag 12 is here represented by the golf bag handle). A flap 52 may also be included. Flap 52 may be attached to golf bag 12 or base member 22 at a lower portion of flap 52, permitting a user to simply pull up flap 52. Using any means for connection, flap 52 may be otherwise coupled to golf bag 12 or to any portion of system 10 to permit a user to seal with flap 52 the opening formed by a fully deployed upper cover 26 and lower cover 28. Flap 52 may have attachment means (e.g., Velcro attachment or any other attachment means) in proximity to edge portions thereof for fastening to lower cover 28 and upper cover 26, sealing the opening formed thereby. One or more locks (not shown, but any conventional lock(s) may be employed) may also be provided to prevent or at least inhibit the ability of an unauthorized user from removing flap 52 and gaining access to golf equipment 50.

Unlocking the one or more locks, if utilized, and pulling down flap 52 provides an opening on the back side of system 10, thereby permitting authorized access to golf equipment 50 while maintaining cover over golf equipment 50 to protect same from exposure to the elements. System 10 may be reversed such that the opening in system 10 permitting access to golf equipment 15 may alternatively be on the front of golf bag 12. This may give the user the option to have access to golf equipment 50 from either the front or the back side of golf bag 12. This reversal may be accomplished by detaching and reattaching base member 22 such that its opening faces the desired direction to permit access to golf equipment 50. This reversal technique may be utilized assuming base member 22 is detachable. In some embodiments, base member 22 may not be detachable and other reversal techniques may be employed, as later described herein.

Figure 2A:
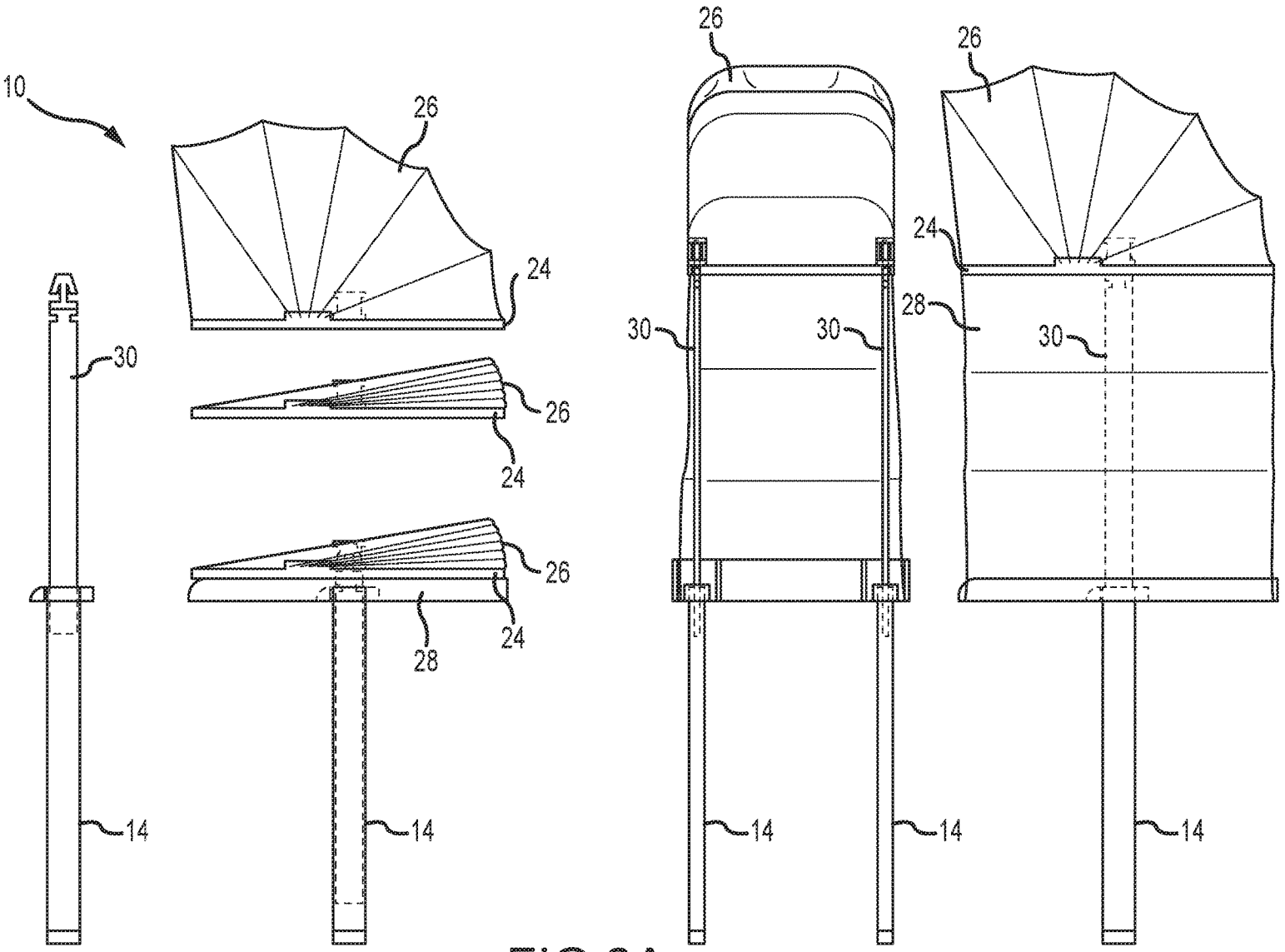
FIGS. 2A and 2B present a series of elevational views of the embodiment of the containment system shown in FIGS. 1A-D, in accordance with systems and methods consistent with the present invention.
Figure 2B:
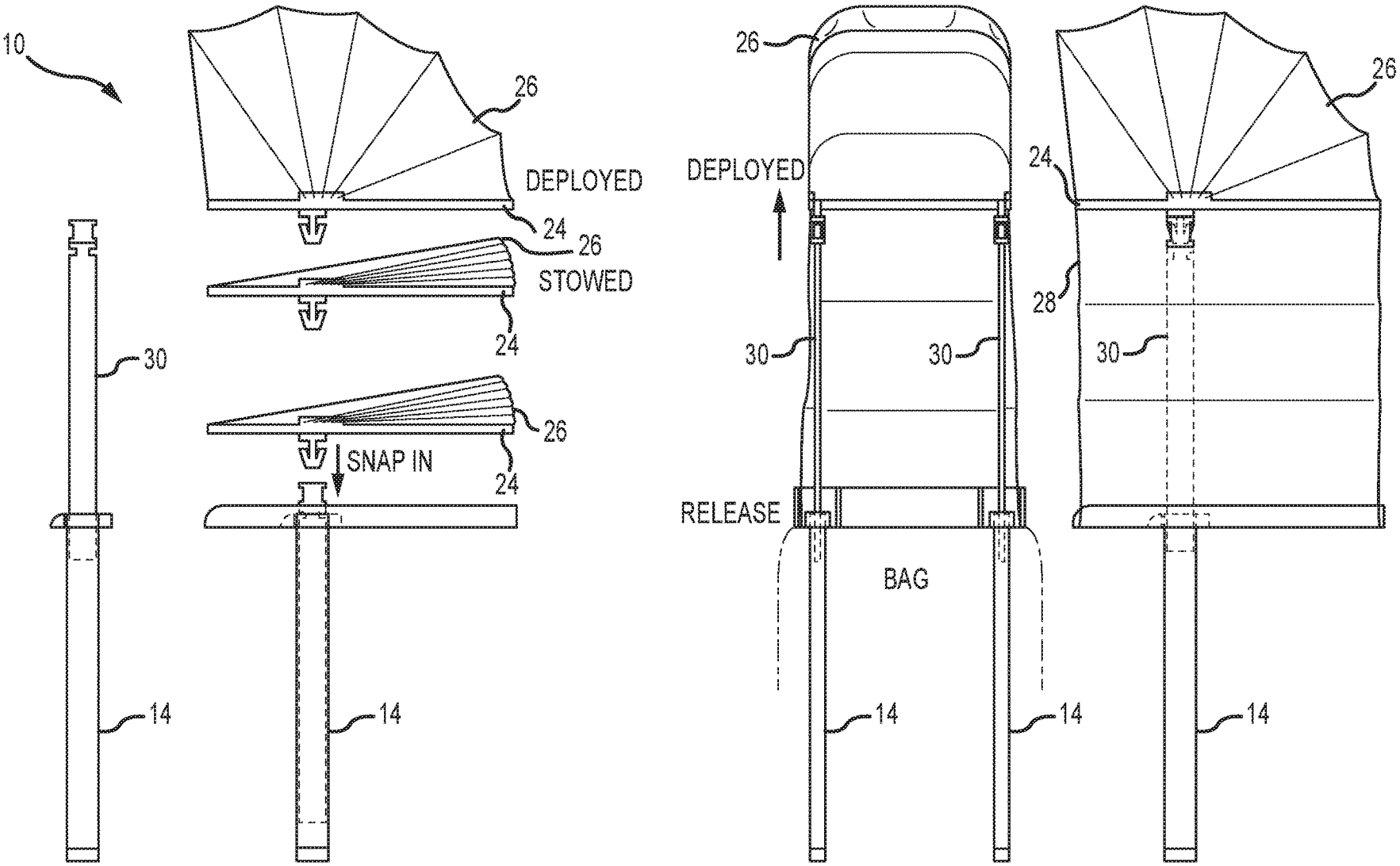

FIGS. 2A and 2B present a series of elevational views of the embodiment of the containment system 10 shown in FIGS. 1A-D, in accordance with systems and methods consistent with the present invention. Referring to FIG. 2A, the leftmost elevational view shows upper member 30 coupled to a lower member 14. In this view, upper member 30 is fully deployed upward, permitting the deployment of system 10, as shown in FIG. 1D. Upper member 30 and lower member 14 may be coupled in a telescopic relationship, such that upper member 30 may be slidably engaged within lower member 14, permitting upper member 30 to move within lower member 14 in both an upward and a downward direction along the vertical axis of lower member 14.

Shifting the focus in FIG. 2A to the right, there appears three views in vertical alignment. The top most of these three views is upper cover 26 shown in a deployed state. The middle view of these three views in vertical alignment is upper cover 26 shown in a partially stowed state. The bottommost view of these three views shown in vertical alignment depicts upper cover 26 and upper member 24 attached to upper member 30 utilizing coupler 18. FIG. 2B shows this snap in relationship. Again shifting focus in FIG. 2A to the right, there is an elevational view of the front of system 10 (i.e., looking into the opening formed by a deployed upper cover 26 and lower cover 28), followed by a side elevational view to the right thereof. Both of these latter two views detect system 10 in a fully deployed state.

FIGS. 3A-3H present a series of perspective views of the embodiment of the containment system 10 shown in FIGS. 1A-D, in accordance with systems and methods consistent with the present invention.

Figure 3A:
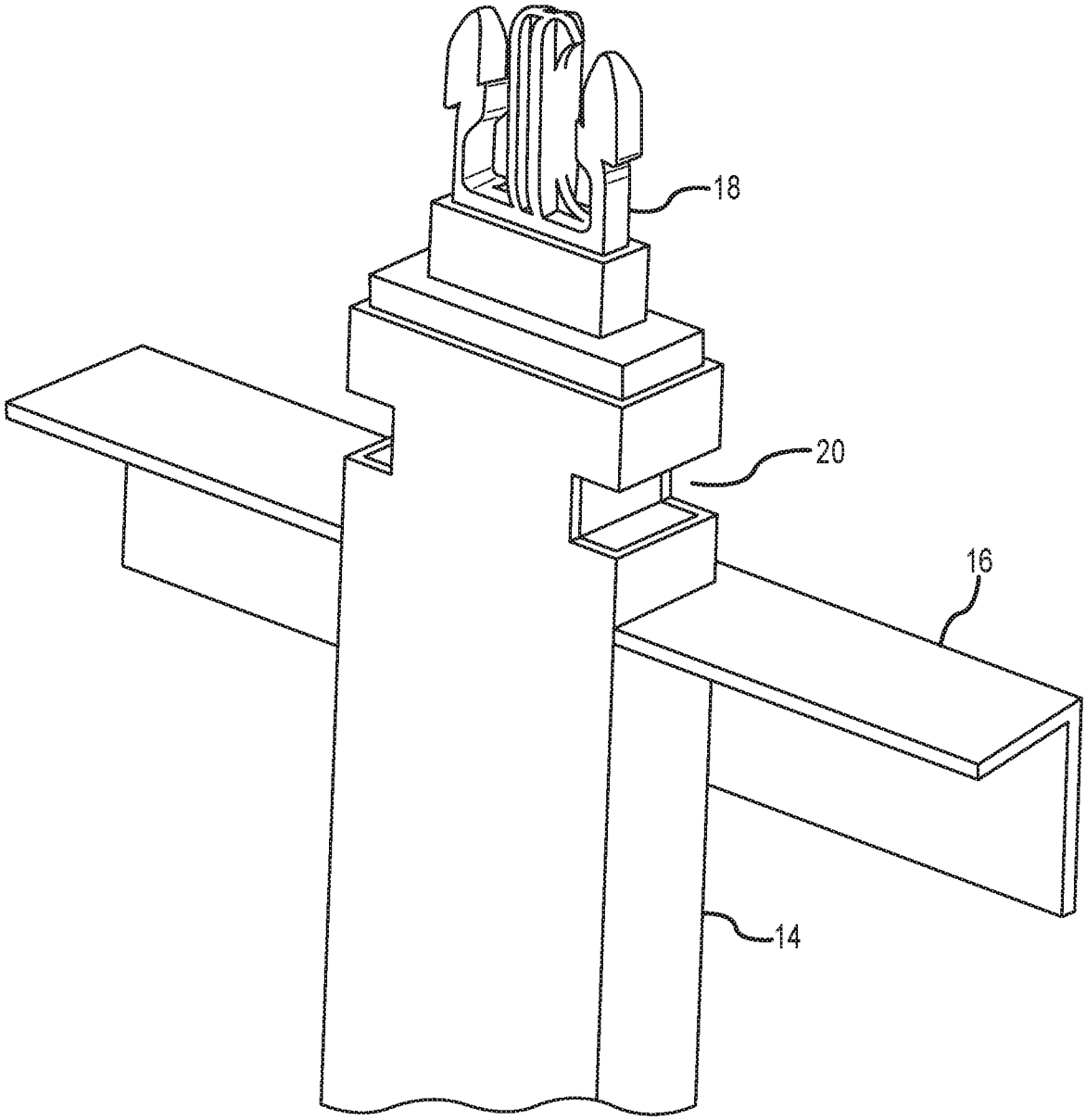
FIGS. 3A-3H present a series of perspective views of the embodiment of the containment system shown in FIGS. 1A-D, in accordance with systems and methods consistent with the present invention.

FIG. 3A shows lower member 14 coupled to retaining clamp 16. Upper member 30 may be retained within lower member 14 in a telescopic fashion, the upper end of upper member 30 extending from lower member 14 to expose coupler 18. A pair of notches 20 may be formed in an upper portion of lower member 14 to facilitate retaining upper member 30 in a stowed state, as shown, until user actuation permits the vertical extension of upper member 30 into a deployed state. The materials that may be used to fabricate retaining clamp 16, lower member 14, upper member 30, coupler 18, base member 22 and upper member 24 may be any desired material; however, it may generally be desirable to employ materials that are sufficiently strong and durable for use in golf bag 12 and that are sufficiently lightweight so as not to add unnecessary weight to golf bag 12. Such materials may include any one or more of, for example, metals, plastics, composites or any other desired materials. The materials that may be used to form upper cover 26 and lower cover 28 may comprise any desired material that may include one or more of, for example, a woven fabric, a plastic or any other desired material that is lightweight and resistant to the weather elements.

Figure 3B:
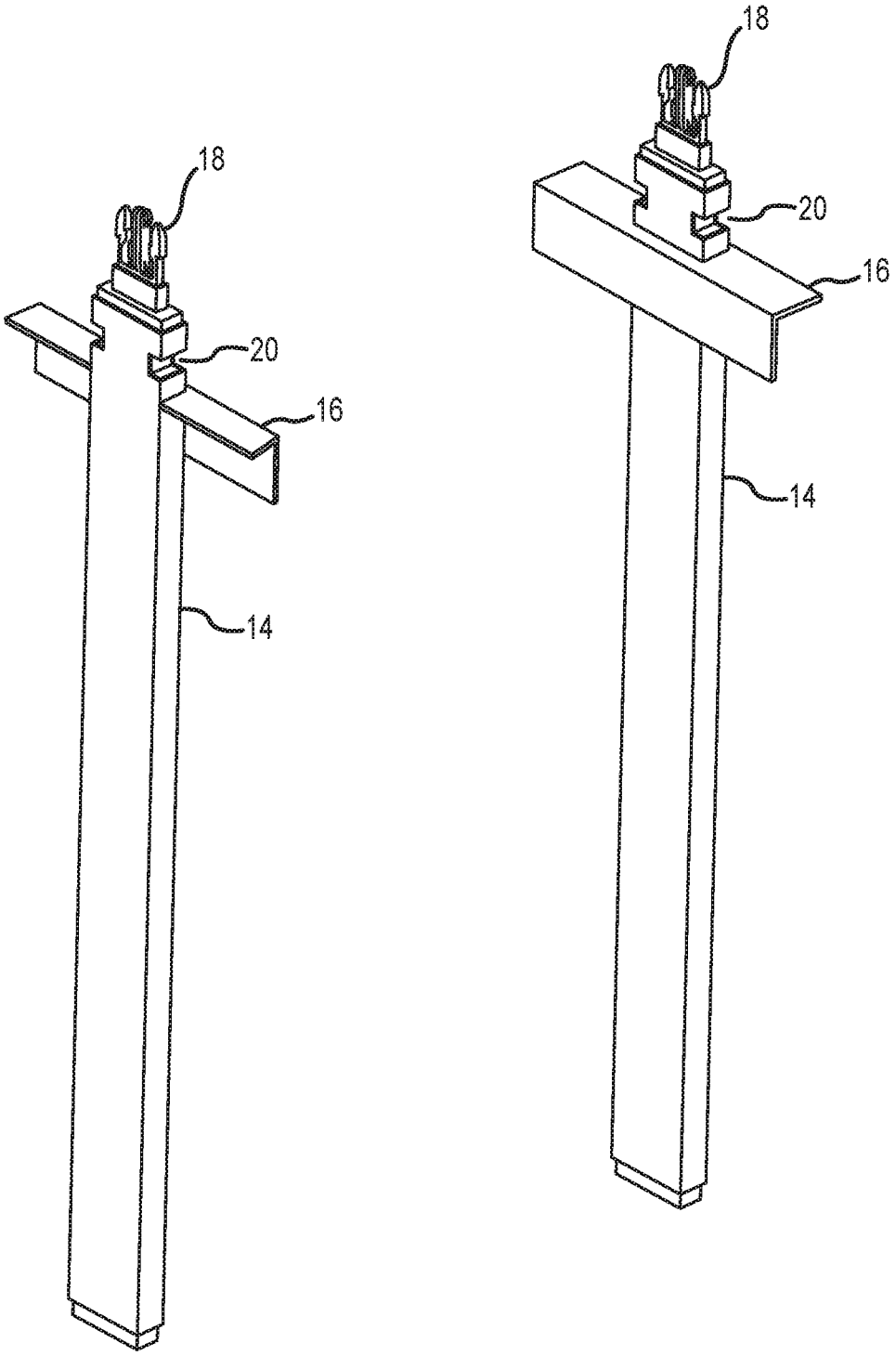

FIG. 3B shows a pair of structures, as shown as a single structure in FIG. 3A. This pair of structures may be attached to an upper portion of golf bag 12, permitting the stowage of lower members 14 within the storage volume of golf bag 12. This pair of structures may generally be affixed to golf bag 12 in proximity to a centerline of golf bag 12, as shown by way of example in FIG. 5.

Figure 3C:
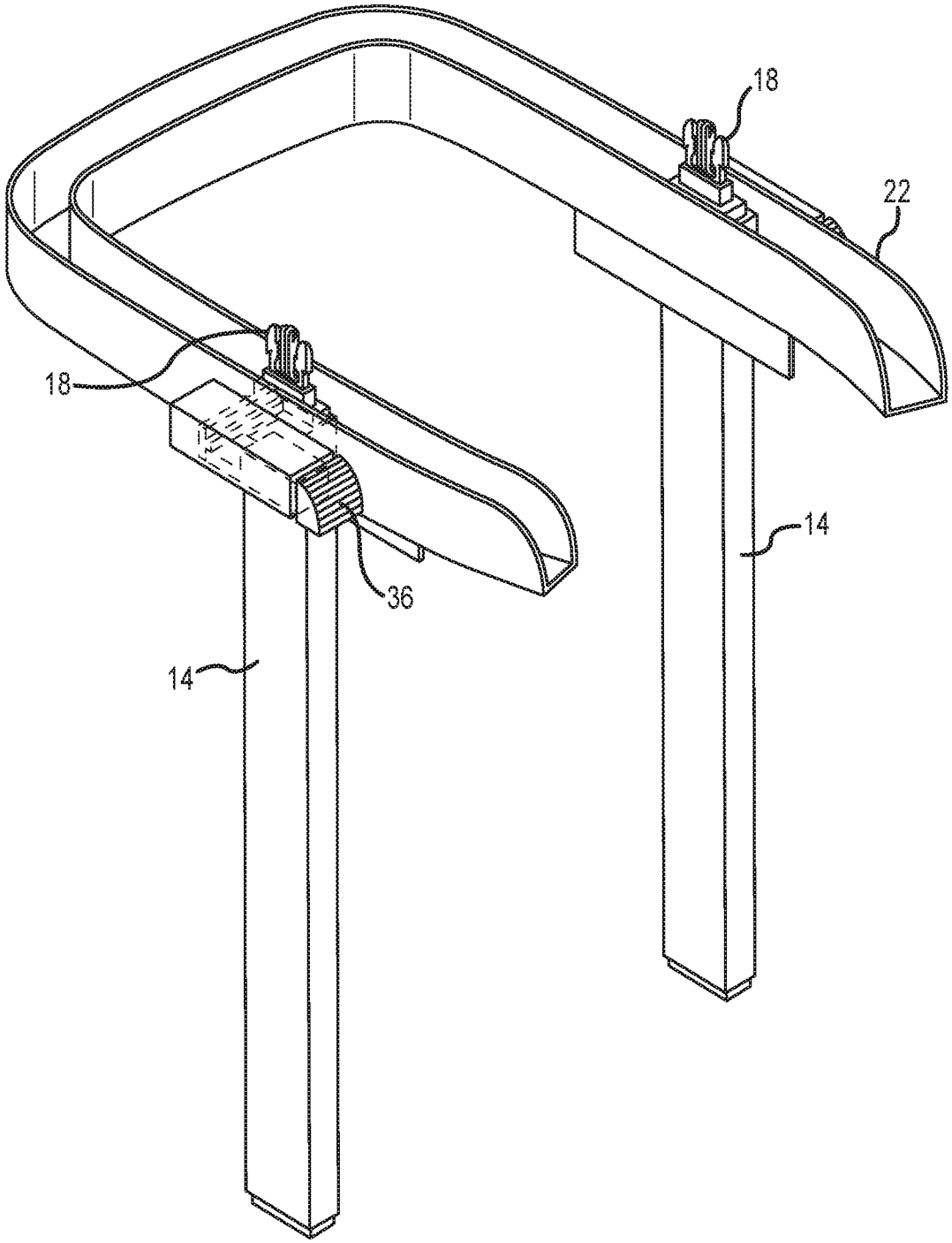
Figure 3D:
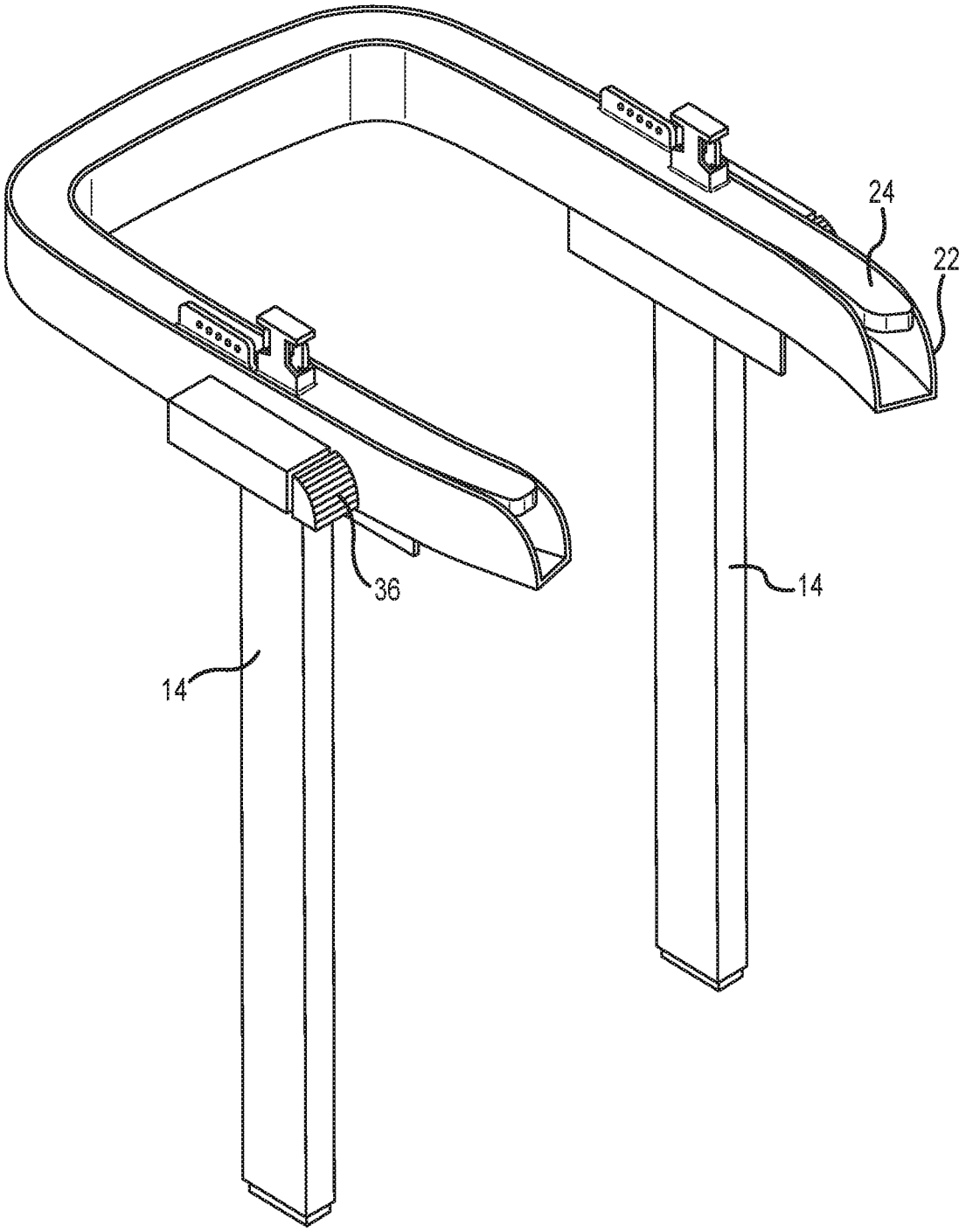
Figure 3E:
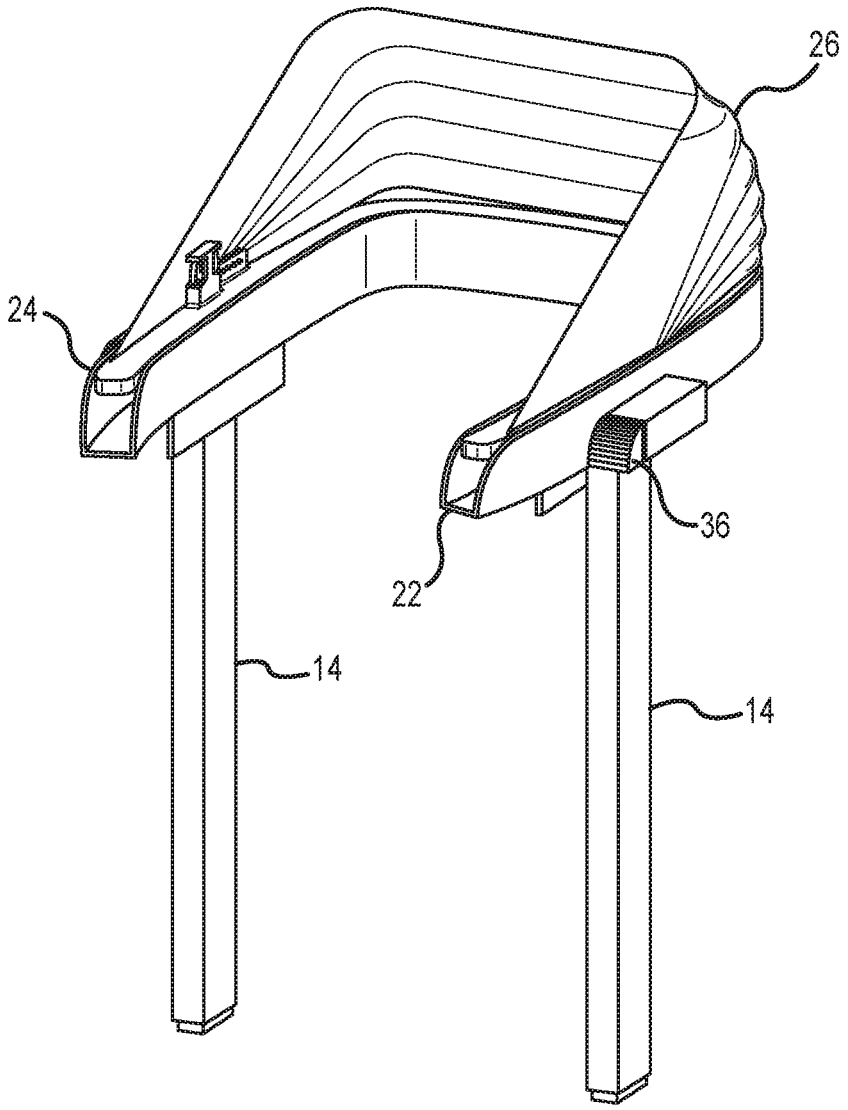
Figure 3F:
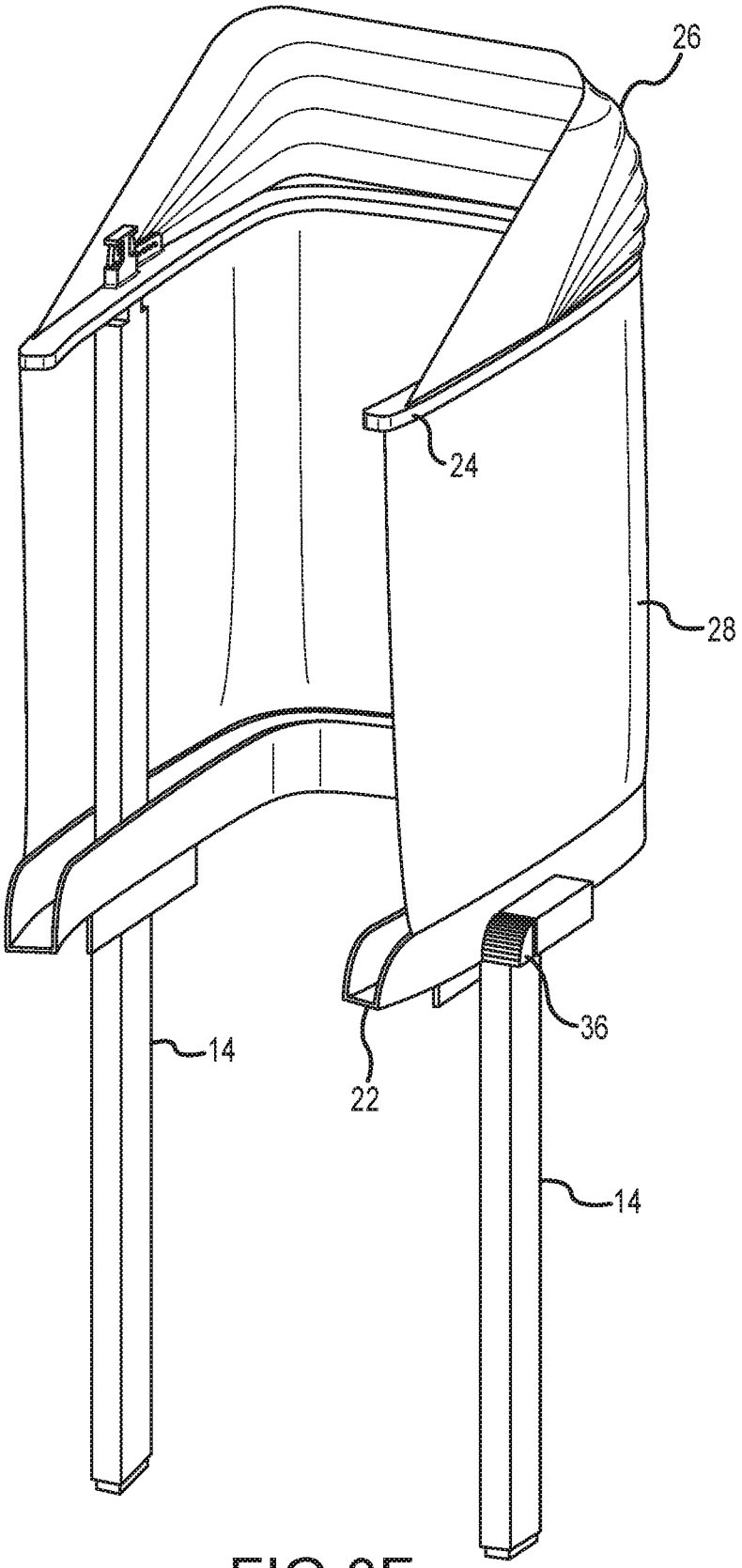
Figure 3G:
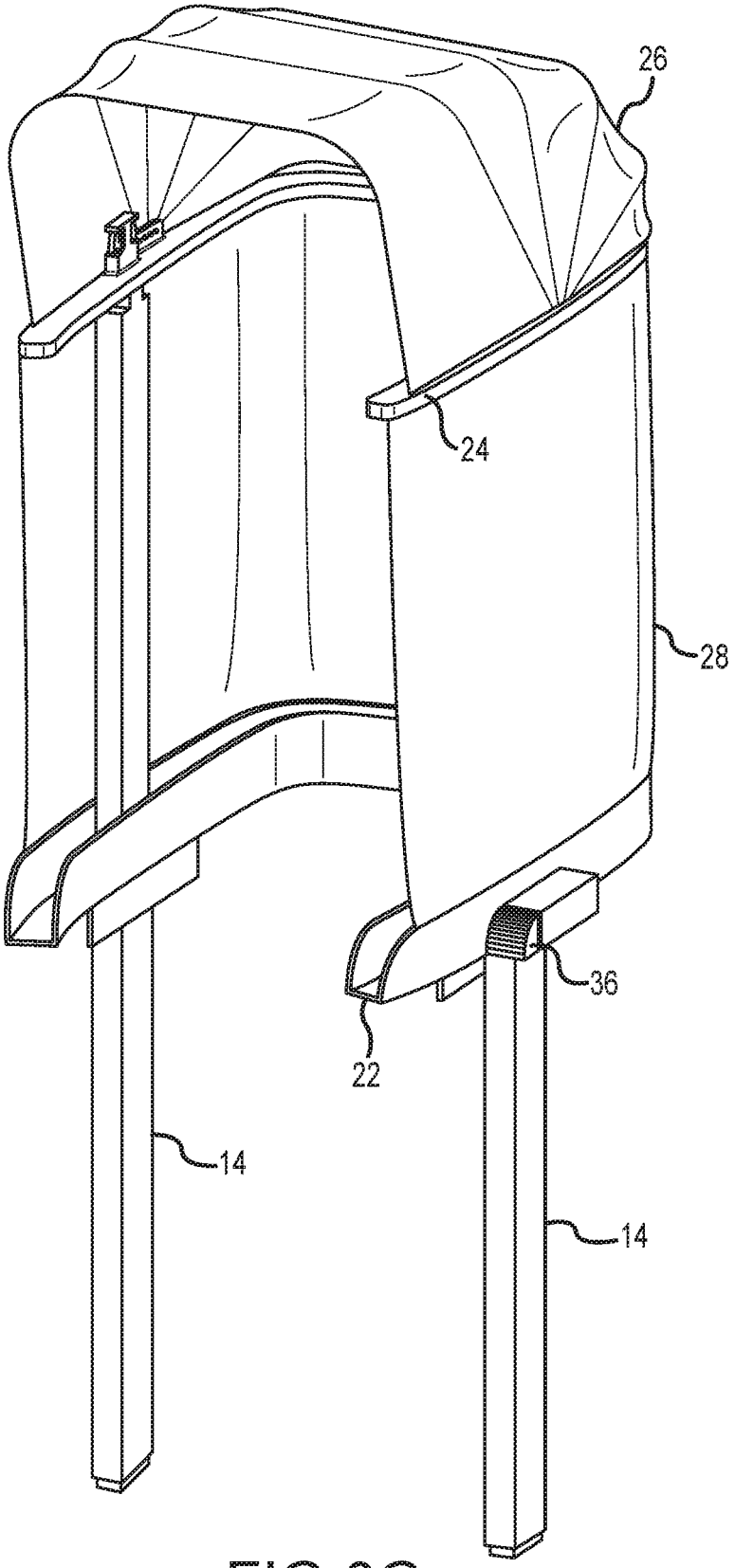
Figure 3H:
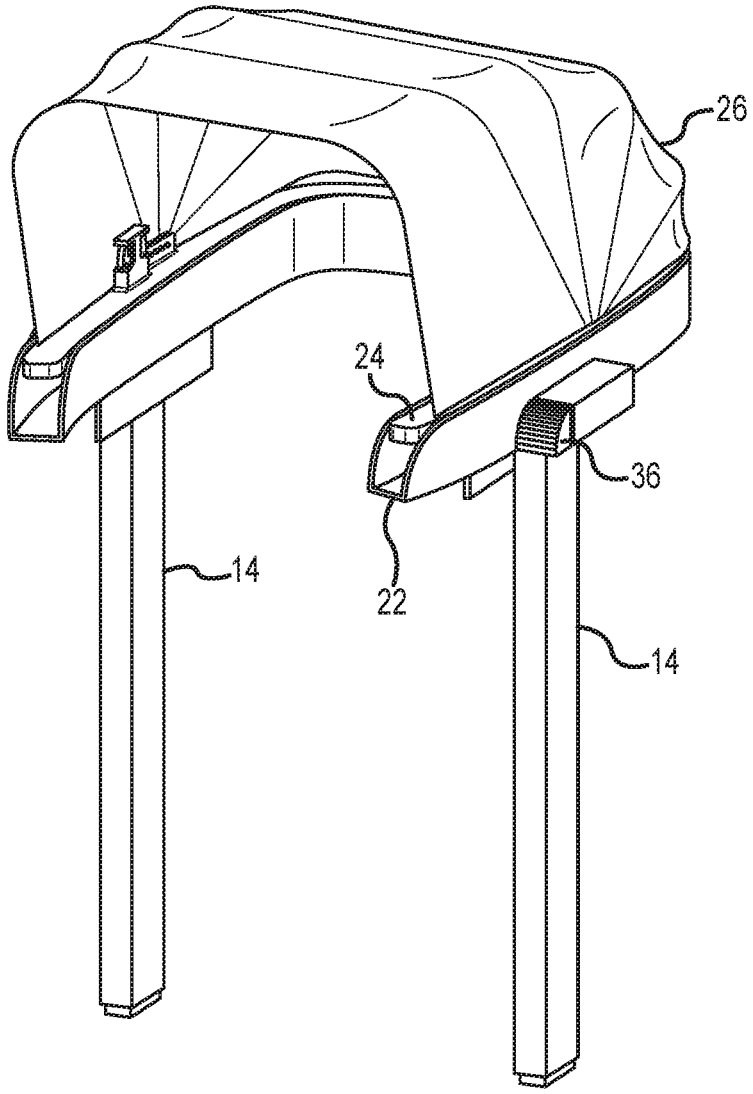

FIG. 3C shows base member 22 coupled to the pair of lower extension members 14. The shape of base member 22 may generally adhere to the shape of an upper portion of golf bag 12 adjacent to which base member 22 may reside. Base member 22 may create a storage volume bounded by the side and lower wall portions of base member 22. The storage volume may be employed to store lower cover 28 and upper member 24, as shown in FIG. 3D. Upper cover 26 may be attached along a lower edge portion thereof to an upper surface of upper member 24. Upper cover 26 may include within the material forming upper cover 26 a number of retention arms intended to form the deployed shape and structure of upper cover 26 when deployed by a user. FIG. 3E shows upper members 30 in a stowed state, while upper cover 26 is shown in a partially deployed state. FIG. 3F shows upper members 30 extended into a deployed state, thereby raising and deploying lower cover 28 into a configuration for providing containment around a portion of golf bag 12. FIG. 3G shows upper cover 26 in a fully deployed state having been moved into this position by a user, the retention arms within upper cover 26 providing structure to keep upper cover 26 deployed until a user restowes upper cover 26. Upper cover 26 and lower cover 28 may provide an opening, as shown in FIG. 3G, allowing a user to have access to golf equipment 50. Again, system 10 may be attached to golf bag 12 such that this opening may be in either the front or the back of golf bag 12. Alternatively, system 10 may be attached to golf bag 12 such that this opening is permanently in either the front or the back of golf bag 12. FIG. 3H shows upper cover 26 in a fully deployed state, while upper members 30 have not yet been deployed, thereby keeping lower cover 28 stowed.

Figure 4:
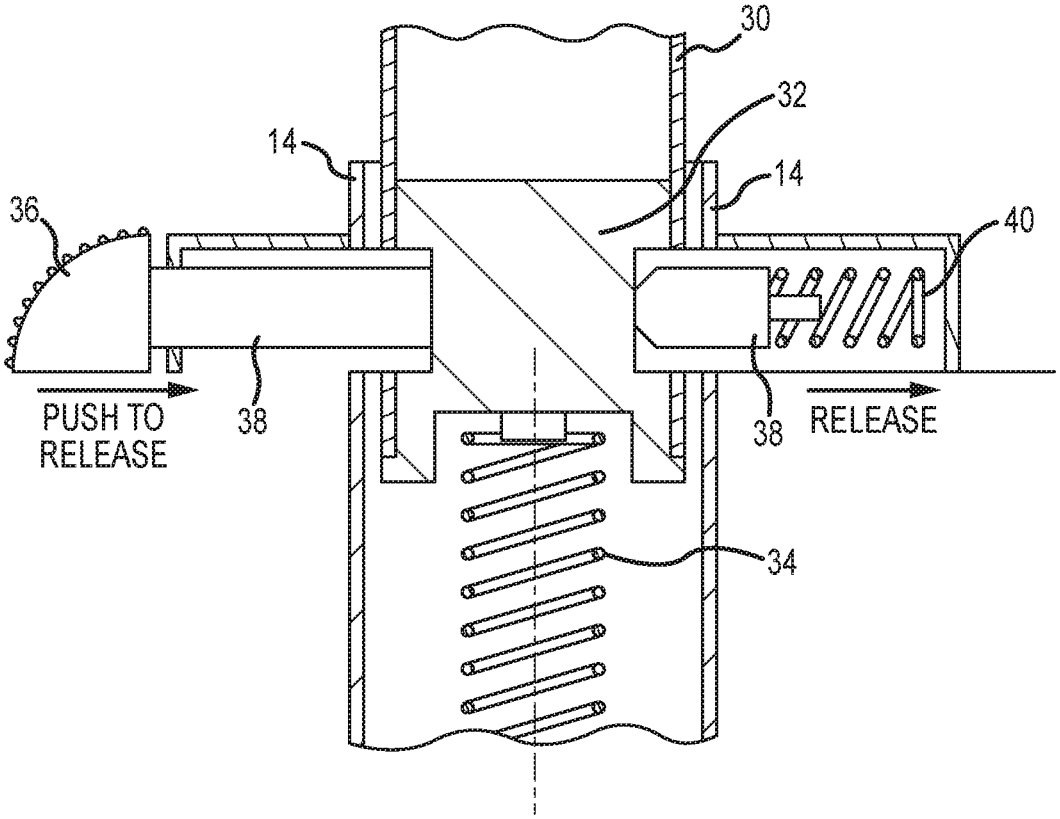
FIG. 4 presents a cross-sectional view of a locking mechanism that may be utilized by embodiments of containment systems, in accordance with systems and methods consistent with the present invention.

FIG. 4 presents a cross-sectional view of a locking mechanism that may be utilized by embodiments of containment systems 10, in accordance with systems and methods consistent with the present invention. FIG. 4 shows the sliding engagement of upper member 30 within lower member 14 in a telescopic configuration. Any other telescopic configuration may be employed to provide one or more members that may be stowed within golf bag 12 in one state and extended into a deployed state to raise lower cover 28. For example, rather than employing an upper member 30 slidably engaged within a lower member 14, as herein shown, one skilled in the art could alternatively have a lower fixed member extending into the golf bag storage volume and an upper member slidably engaged in a side-by-side guide-rail attachment scheme, permitting the upper member to be stowed inside the golf bag storage volume and selectively raised into a deployed state using the side-by-side guide-rail attachment scheme. Any other technique for providing one or more telescopic members may be employed by system 10.

In the exemplary embodiment depicted, upper member 30 may include a mechanical stop 32, which may keep upper member 30 within lower member 14 when deployed by activation of release actuator 36. Release actuator 36 may be coupled to a shaft 38 which may extend around, in a C-shaped configuration, either or both of lower member 14 and upper member 30. A spring 40 may operate against shaft 38 to keep upper member 30 in a stowed state when shaft 38 is engaged in notch 20, as shown in FIGS. 3A and 3B. When a user wishes to deploy the containment system 10, the user depresses release actuator 36, which moves shaft 38 against the force of spring 40 and releases shaft 38 from notch 20, thereby allowing spring 34 to raise upper member 30 by force against mechanical stop 32. When a user wishes to restow the containment system 10, the user again depresses release actuator 36, which moves shaft 38 against the opposing force of spring 40, thereby removing shaft 38 from the holding notch shown in mechanical stop 32 and allowing a user to fold back against itself upper cover 26 and to push down on upper members 30 to restow upper members 30 and lower cover 28 and permit shaft 38 to reengage with notch 20 to hold the system in a stowed state until system deployment is again desired. Those skilled in the art will understand that either or both of springs 34 and 40 may be replaced by other force-generating mechanisms, such as compressed air or any other desirable force-generating mechanism.

Figure 5:
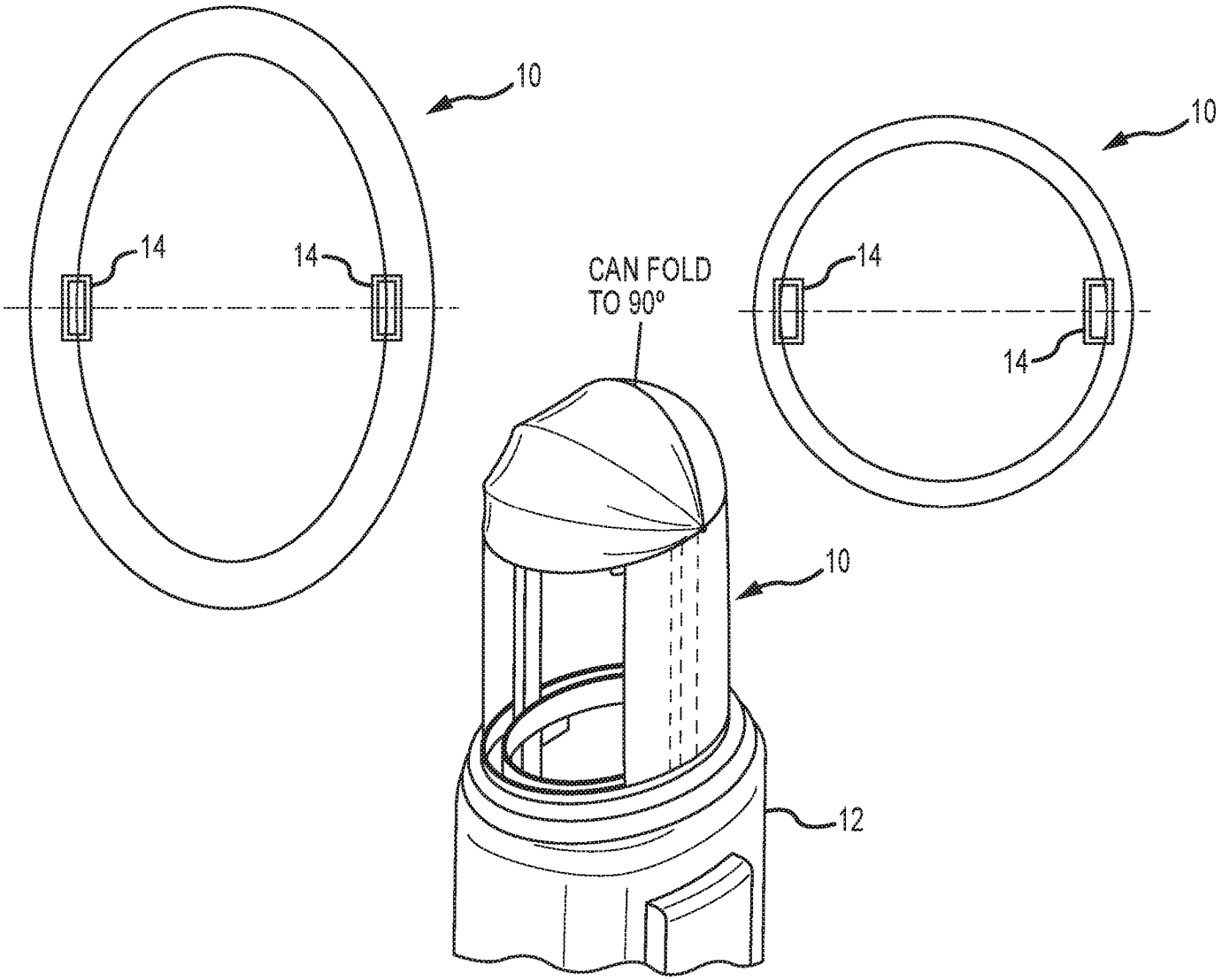
FIG. 5 presents a series of planar views of additional embodiments of containment systems, as well as one perspective view of an additional embodiment of a containment system, in accordance with systems and methods consistent with the present invention.

FIG. 5 presents a series of planar views of additional embodiments of containment systems 10, as well as one perspective view of an additional embodiment of a containment system 10, in accordance with systems and methods consistent with the present invention. The embodiment of containment system 10 shown in FIGS. 1A-D, 2A, 2B and 3A-H employs a base member 22 having a generally squared-off shape to match a generally squared-off shape of an upper portion of a corresponding golf bag 12. The embodiments of containment systems 10 shown in FIG. 5 depict an elliptical configuration and a circular configuration, meaning base member 22 and structures formed to fit within base member 22 may have a similar configuration to match the shape of an upper portion of a corresponding golf bag 12. Those skilled in the art will understand that any shape may be employed for system 10, depending on the shape and configuration of an upper portion of the golf bag 12 to which containment system 10 may be integrated. The perspective view in FIG. 5 is of an elliptically-shaped system 10, shown by way of example to include means to retain upper cover 26 at a 90-degree point (i.e., half-way deployed). Those skilled in the art will understand the many various ways in which this feature may be provided. This feature may be employed with any embodiment of system 10 disclosed herein.

Figure 6A:
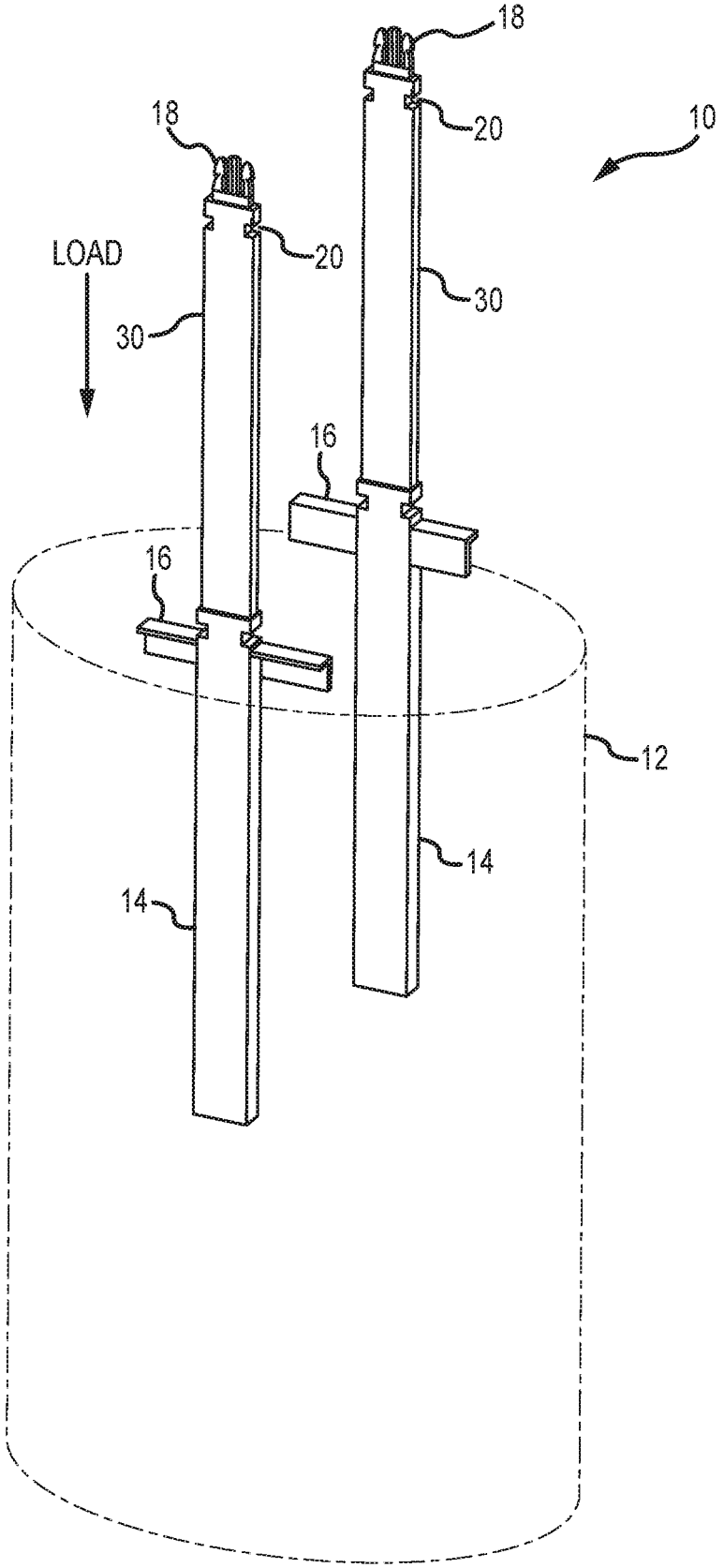
FIGS. 6A-I present a series of views of another embodiment of a containment system, in accordance with systems and methods consistent with the present invention.

FIGS. 6A-I present a series of perspective views of another embodiment of containment system 10, in accordance with systems and methods consistent with the present invention. The embodiment of containment system 10 depicted in FIGS. 6A-I corresponds to the elliptical configuration depicted in FIG. 5. FIG. 6A shows that retaining clamps 16 may be coupled to upper opposing surfaces of golf bag 12 (e.g., opposing along a centerline of golf bag 12), the result of which is that the pair of lower members 14 reside within a storage volume of golf bag 12. Upper members 30 are shown in a deployed state. In this figure, base member 22, upper member 24, lower cover 28 and upper cover 26 are not shown.

Figure 6B:
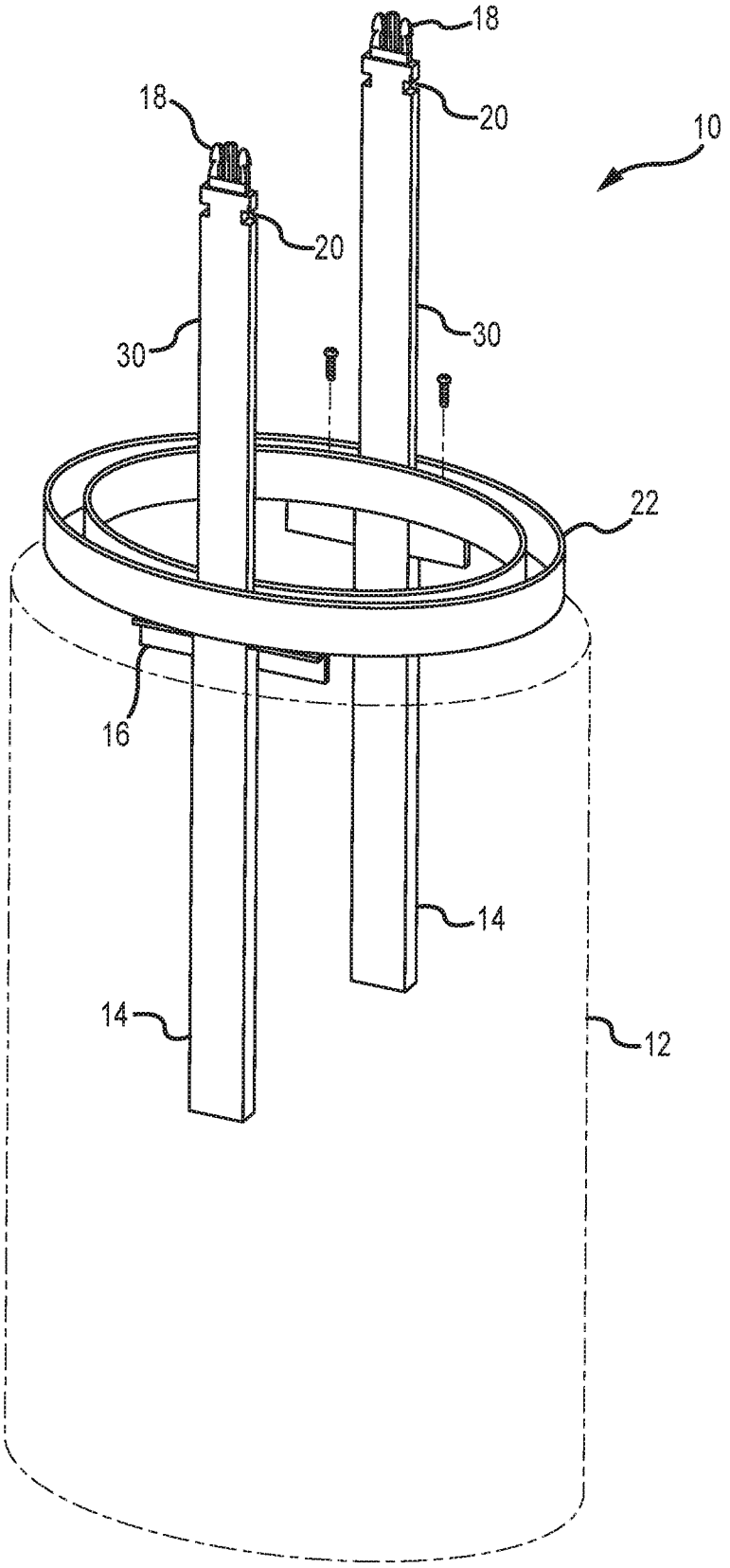
Figure 6C:
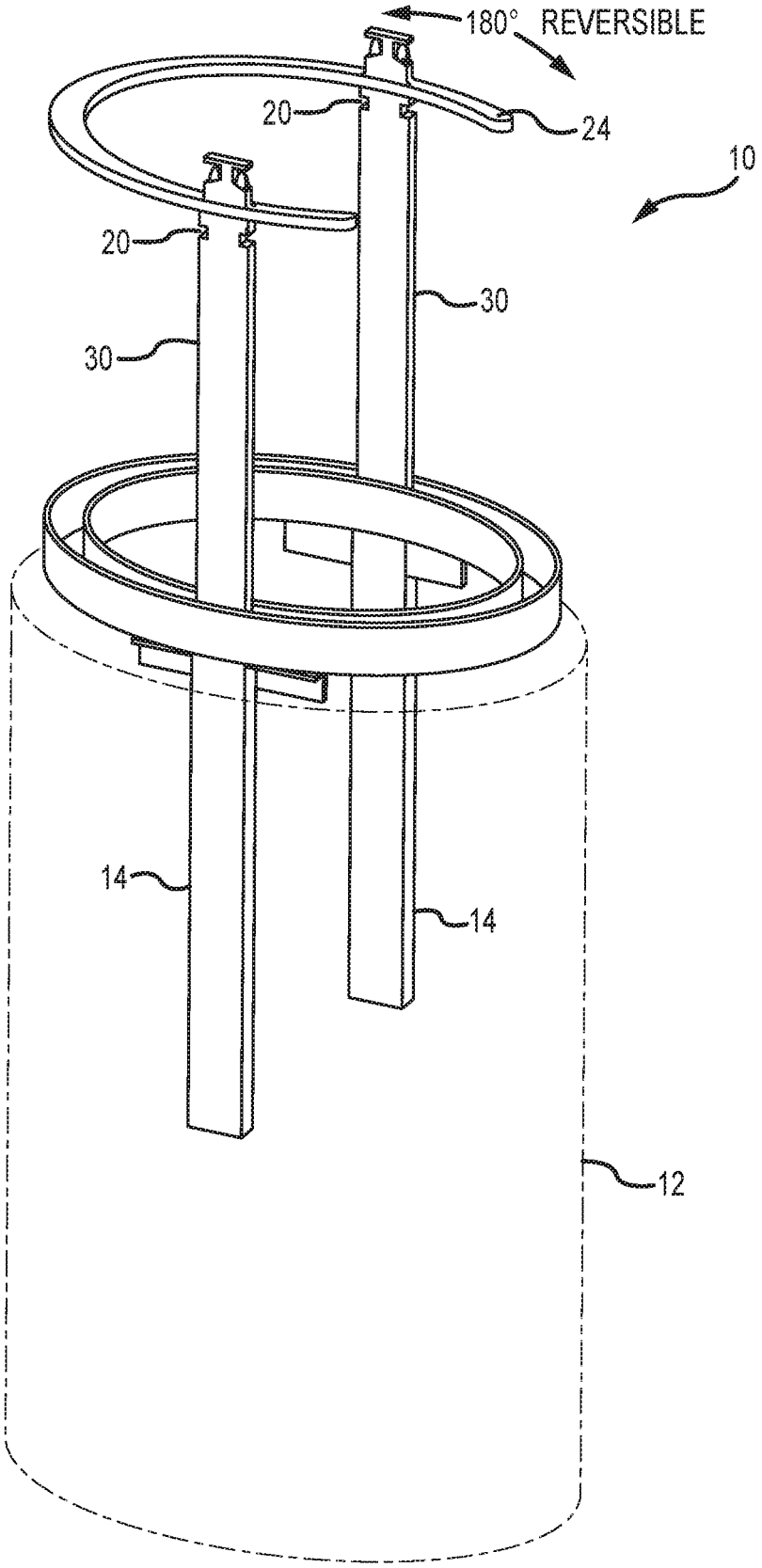
Figure 6D:
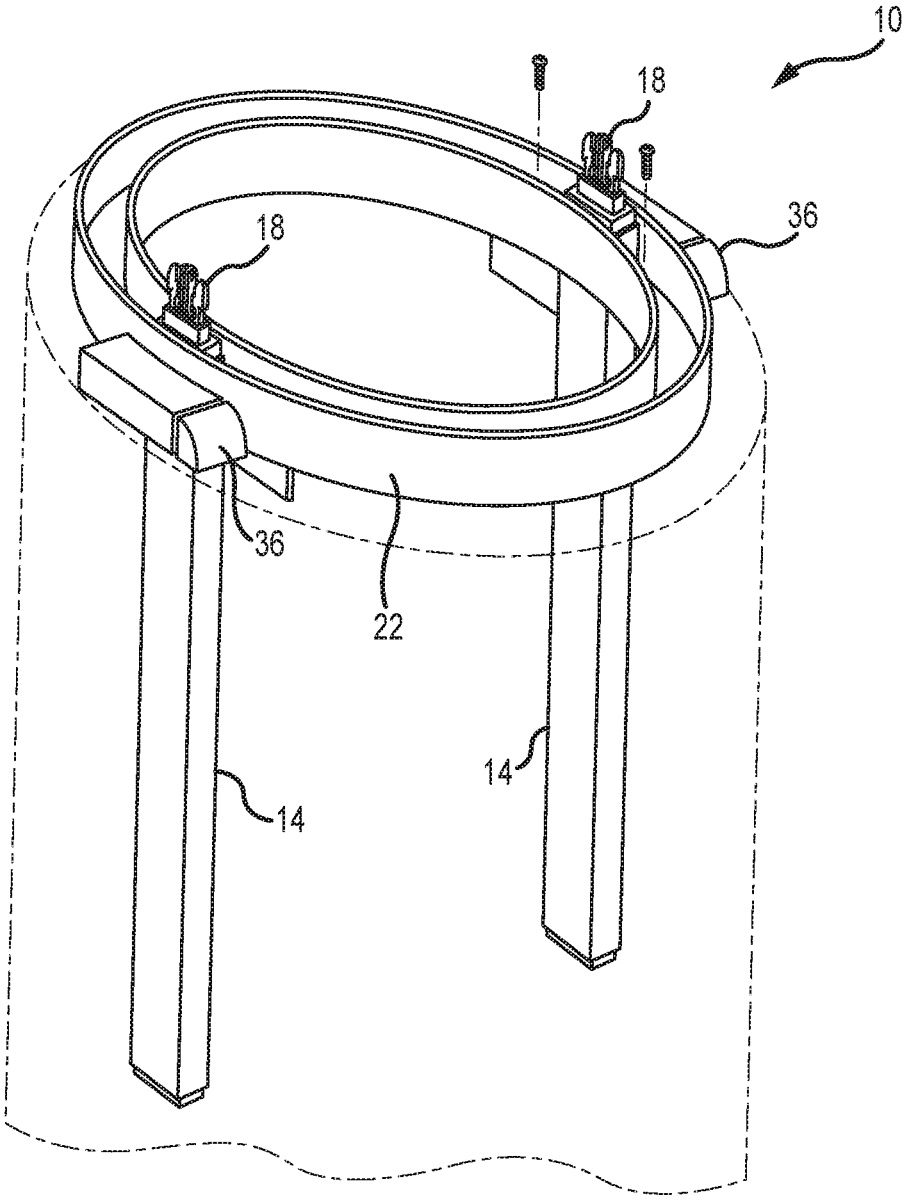
Figure 6E:
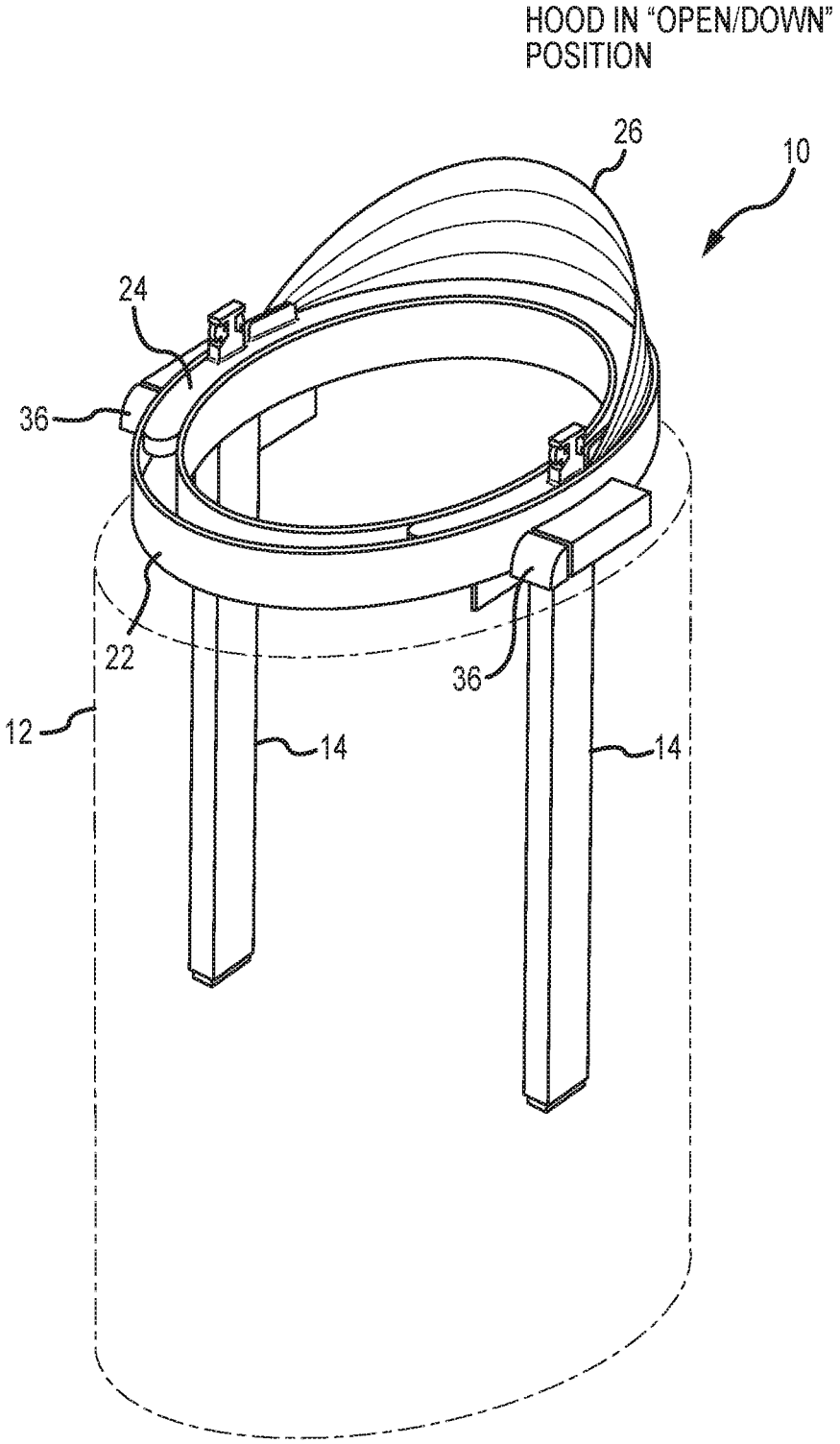
Figure 6F:
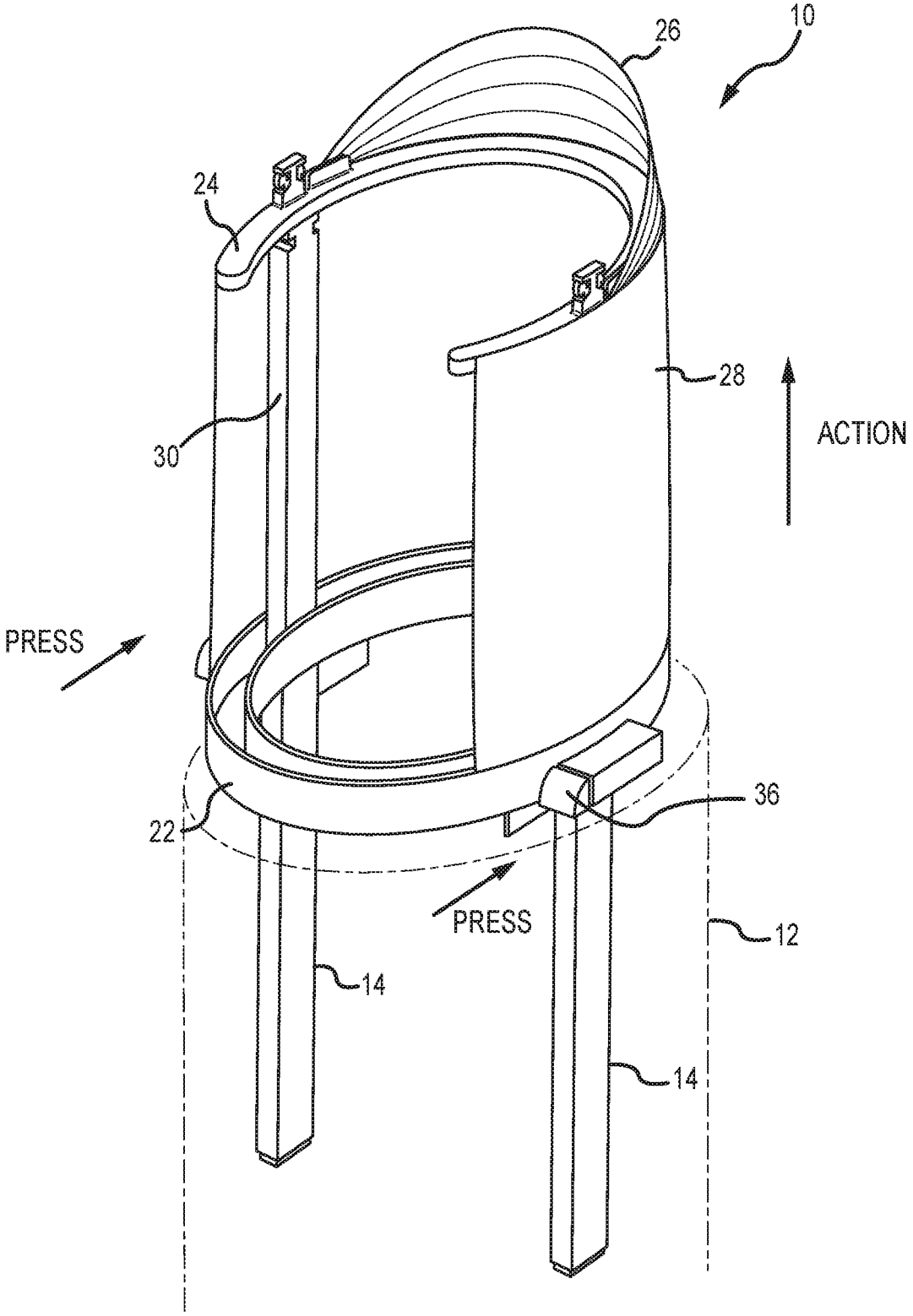
Figure 6G:
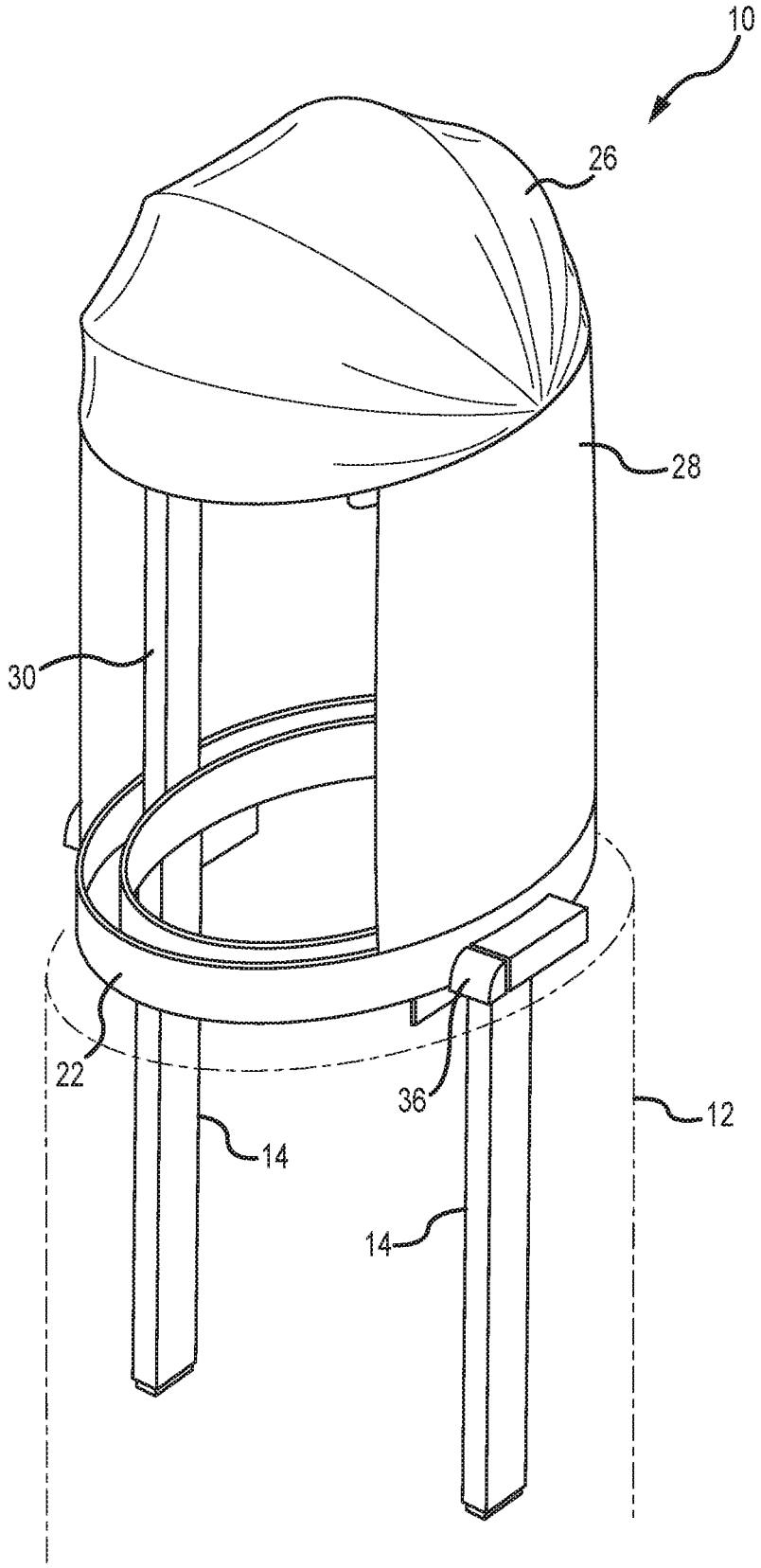
Figure 6H:
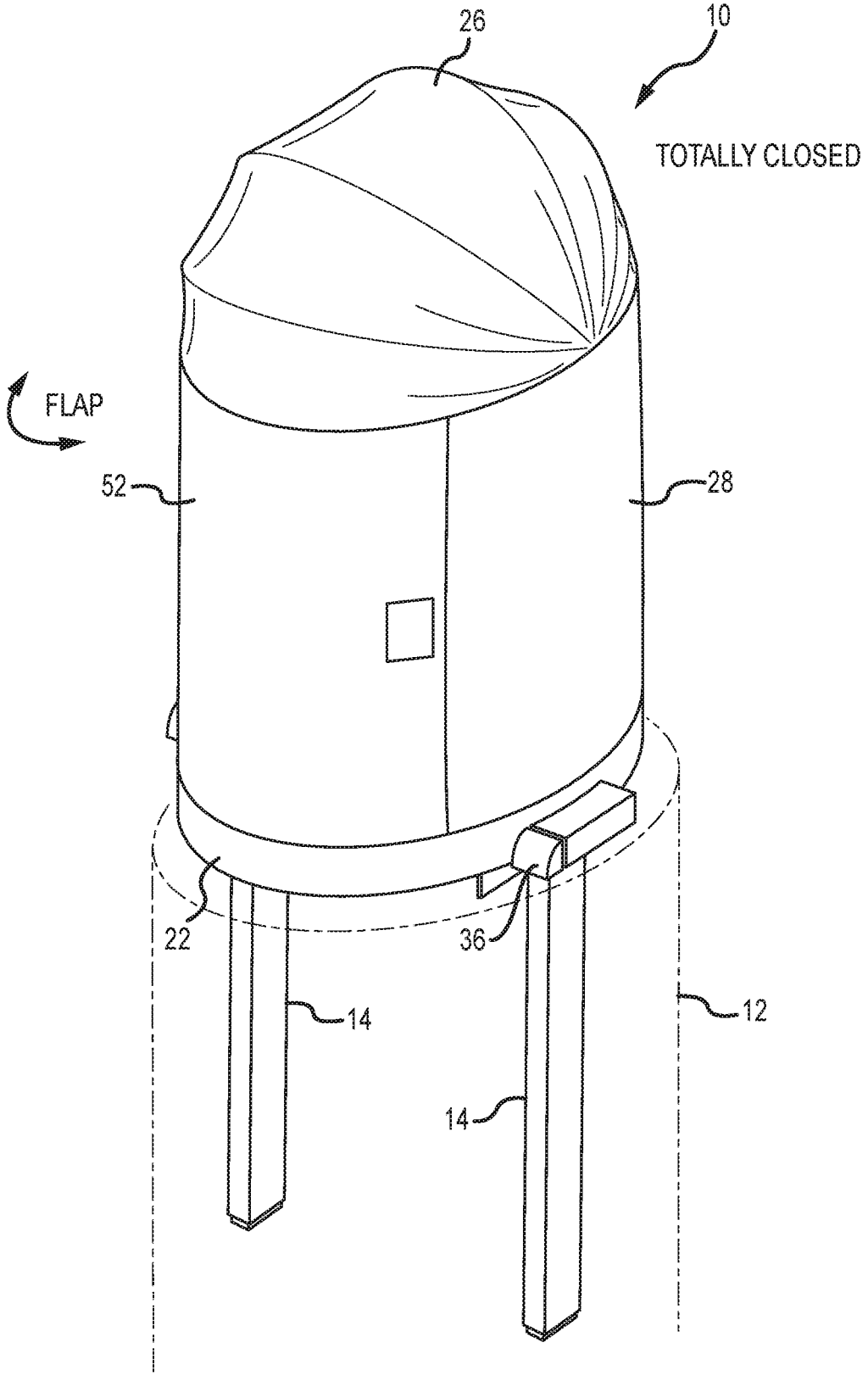
Figure 6I:
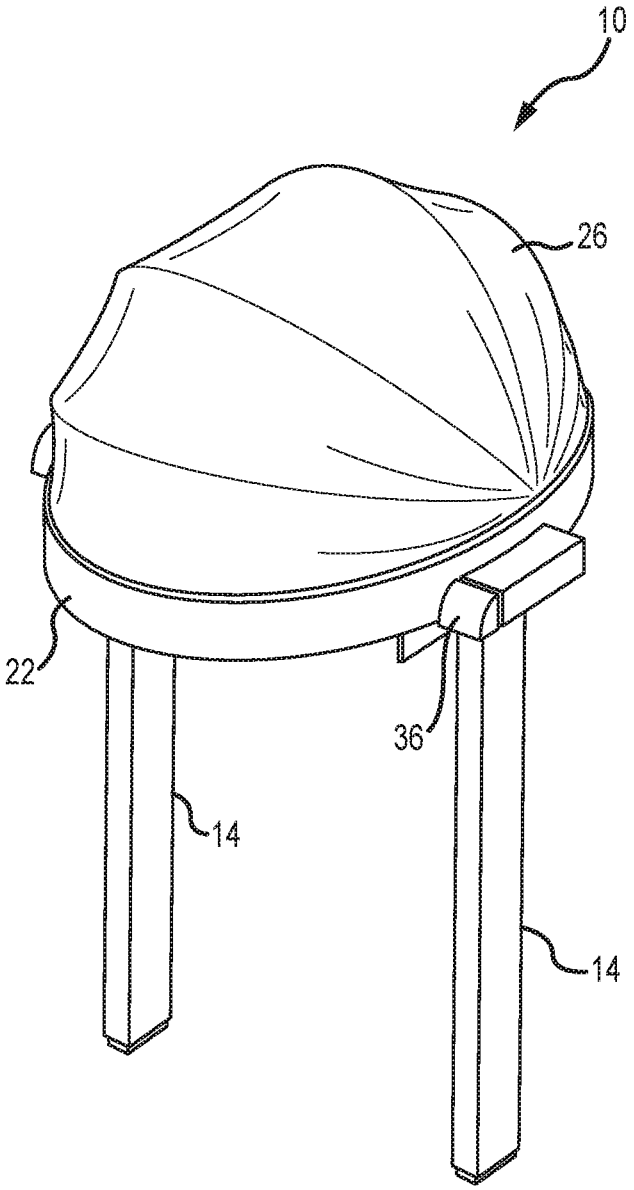

FIG. 6B shows that base member 22 may have a fully enclosed elliptical shape. In an alternative embodiment, base member 22 may have a generally elliptical shape, but not be fully enclosed (i.e., it may have a portion removed, creating an opening analogous to that shown by the embodiment of containment system 10 shown in FIGS. 1A-D, 2A, 2B and 3A-H). In other words, the "missing" portion (i.e., the "missing" portion creates the open end) of upper member 24, as shown in FIG. 6C, may have a corresponding "missing" portion in base member 22, as opposed to the fully enclosed base member 22 shown. FIG. 6C demonstrates that upper member 24 may be selectively removed and reattached to reverse the end of golf bag 12 for which the opening for access to golf equipment 50 exists. Those skilled in the art will understand the many and various ways in which this feature may be provided. FIG. 6D shows upper members 30 in a stowed state. FIG. 6E shows upper cover 26 in an open and down position (i.e., the upper cover 26 is partially deployed and down, leaving a maximum-sized opening to golf equipment 50). FIG. 6F shows the system 10 in a deployed state in which upper members 30 are raised and upper cover 26 has not yet been pulled forward by a user. FIG. 6G shows system 10 in a deployed state in which the user has pulled forward upper cover 26, leaving an opening for a user to easily access golf equipment 50. FIG. 6H shows a flap 52 covering the aforementioned opening. Flap 52 may have an edge portion that may be coupled to lower cover 28 or it may comprise a separate piece that may be attached by a user to lower cover 28 and upper cover 26 by some attachment means, such as Velcro attachment or any other desired means for attachment. Flap 52, if pre-attached in some form, may be so attached to any desired portion of system 10 or golf bag 12. One or more locks (not shown) may be employed with this embodiment of system 10 for added security. FIG. 6I shows upper cover 26 in a fully deployed state, while upper members 30 have not been deployed.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for protecting contents of a provided golf bag, the system comprising:

at least one telescopic member coupled to the provided golf bag, wherein the at least one telescopic member resides in a stowed state substantially within the provided golf bag and is selectively moveable to a deployed state to facilitate protecting the contents of the provided golf bag;

a cover coupled to the at least one telescopic member, wherein the cover resides in a stowed state when the at least one telescopic member is in its stowed state and is selectively moveable by movement of the at least one telescopic member to a deployed state for the cover to protect the contents of the provided golf bag; and a base member coupled to the provided golf bag, the base member having a shape conforming to a shape of an upper rim of the provided golf bag.

2. The system of claim 1, wherein the at least one telescopic member comprises:

a first telescopic member coupled to the provided golf bag, wherein the first telescopic member resides in the stowed state substantially within the provided golf bag and is selectively moveable to the deployed state to facilitate protecting the contents of the provided golf bag; and a second telescopic member coupled to the provided golf bag, wherein the second telescopic member resides in the stowed state substantially within the provided golf bag and is selectively moveable to the deployed state to facilitate protecting the contents of the provided golf bag.

3. The system of claim 2 wherein the first telescopic member is located opposite the second telescopic member and the first telescopic member and the second telescopic member are disposed in proximity to a centerline of an upper rim of the provided golf bag.

4. The system of claim 1 wherein portions of the base member form a cavity in which the cover is stored in the stowed state for the cover.

5. The system of claim 4 further comprising a support member that in a stowed state resides within a portion of the cavity and in a deployed state holds the cover in its deployed state to facilitate protecting the contents of the provided golf bag.

6. The system of claim 5 further comprising a second cover coupled to the support member, wherein the second cover has a stowed state in which the second cover is folded against itself and abutting the support member and a deployed state in which the second cover is expanded to form a barrier over an opening formed by the upper rim of the provided golf bag, while forming an opening bounded by the second cover to permit a user to access the contents of the provided golf bag.

7. The system of claim 6 further comprising a third cover for selectively sealing the opening bounded by the second cover.

8. The system of claim 7 further comprising a lock coupled to the third cover for restricting access to the contents of the provided golf bag.

9. The system of claim 6 wherein an orientation of the opening bounded by the second cover is open to one of a front portion of the provided golf bag and a back portion of the provided golf bag.

10. The system of claim 1 wherein the at least one telescopic member is slidably engaged by the base member.

11. The system of claim 1 wherein the cover, when in its deployed state, forms a barrier that is in alignment with and extends upwardly from a portion of the upper rim of the provided golf bag.

12. The system of claim 1 further comprising an actuator coupled to the at least one telescopic member, the actuator retaining the at least one telescopic member in the stowed state and selectively permitting by user activation the automatic raising of the at least one telescopic member to the deployed state to facilitate protecting the contents of the provided golf bag.

13. The system of claim 1 wherein the shape of the base member comprises one or more of an elliptical shape, a circular shape, a rectangular shape and a squared-off shape.

14. A system for protecting golf bag contents, the system comprising:

a golf bag;

at least one telescopic member coupled to the golf bag, wherein the at least one telescopic member resides in a stowed state substantially within the golf bag and is selectively moveable to a deployed state to facilitate protecting the contents of the golf bag; and a cover coupled to the at least one telescopic member, wherein the cover resides in a stowed state when the at least one telescopic member is in its stowed state and is selectively moveable by movement of the at least one telescopic member to a deployed state for the cover to protect the contents of the golf bag; and a base member coupled to the golf bag, the base member having a shape conforming to a shape of an upper rim of the golf bag.

15. The system of claim 14, wherein the at least one telescopic member comprises:

a first telescopic member coupled to the golf bag, wherein the first telescopic member resides in the stowed state substantially within the golf bag and is selectively moveable to the deployed state to facilitate protecting the contents of the golf bag; and a second telescopic member coupled to the provided golf bag, wherein the second telescopic member resides in the stowed state substantially within the provided golf bag and is selectively moveable to the deployed state to facilitate protecting the contents of the provided golf bag.

16. The system of claim 14 wherein portions of the base member form a cavity in which the cover is stored in the stowed state for the cover.

17. The system of claim 16 further comprising a support member that in a stowed state resides within a portion of the cavity and in a deployed state holds the cover in its deployed state to facilitate protecting the contents of the golf bag.

18. The system of claim 14 wherein the at least one telescopic member is slidably engaged by the base member.

* * * * *